US006751424B2

(12) United States Patent
Komatsu et al.

(10) Patent No.: US 6,751,424 B2
(45) Date of Patent: Jun. 15, 2004

(54) IMAGE-FORMING METHOD IN HIGH-SPEED MODE AND IN LOW-SPEED MODE

(75) Inventors: Nozomu Komatsu, Shizuoka (JP); Takaaki Kotaki, Shizuoka (JP); Makoto Kanbayashi, Shizuoka (JP); Takaaki Kaya, Shizuoka (JP); Wakashi Iida, Ibaraki (JP); Nobuyoshi Sugahara, Shizuoka (JP); Takayuki Itakura, Shizuoka (JP); Yojiro Hotta, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/329,384

(22) Filed: Dec. 27, 2002

(65) Prior Publication Data

US 2003/0162118 A1 Aug. 28, 2003

(30) Foreign Application Priority Data

Dec. 28, 2001 (JP) ..... 2001-400660

(51) Int. Cl.[7] ..... G03G 15/20

(52) U.S. Cl. ..... 399/68; 399/45; 399/82; 399/322; 399/328

(58) Field of Search ..... 219/216; 399/45, 399/68, 82, 85, 320, 322, 328, 396; 430/109

(56) References Cited

U.S. PATENT DOCUMENTS

| | | | | |
|---|---|---|---|---|
| 6,074,794 A | | 6/2000 | Fushimi et al. | 430/109 |
| 6,078,760 A | * | 6/2000 | Abe et al. | 399/45 |

FOREIGN PATENT DOCUMENTS

| | | |
|---|---|---|
| EP | 0794469 | 9/1997 |
| EP | 0819994 | 1/1998 |
| EP | 0864942 | 9/1998 |
| EP | 1065569 | 1/2001 |
| JP | 63-92965 | 4/1988 |
| JP | 3-38659 | 2/1991 |
| JP | 5-216322 | 8/1993 |
| JP | 11-84719 | 3/1999 |

OTHER PUBLICATIONS

Patent Abstracts of Japan, 16, 5 (p–1295) 1992.
Patent Abstracts of Japan, 2000, 22 (2001).

* cited by examiner

*Primary Examiner*—Hoang Ngo
(74) *Attorney, Agent, or Firm*—Fitzpatrick, Cella, Harper & Scinto

(57) ABSTRACT

An image-forming method for fixing a toner image onto a recording medium, (i) wherein when a high-gloss recording medium ($G_0$>40) is used, an image is formed at a low-speed mode process speed of from 20 mm/sec. to less than 130 mm/sec. and, where the maximum and minimum gloss values of the fixed image ($G_{max1}$ and $G_{min1}$, respectively), satisfy: $G_{max1} \leqq G_0+40$ and $G_{min1} \geqq G_0-25$; and (ii) wherein when a low-gloss recording medium ($0 \leqq G_0 \leqq 40$) is used, an image is formed at a high-speed mode process speed of from 130 mm/sec. to 600 mm/sec. and, where values of the fixed image ($G_{max2}$ and $G_{min2}$, respectively), satisfy: $G_{max2} \leqq G_0+20$ and $G_{min2} \geqq G_0-15$.

12 Claims, 3 Drawing Sheets

IMAGE-FORMING METHOD IN HIGH-SPEED MODE AND IN LOW-SPEED MODE

BACKGROUND OF THE INVENTION

1. Field of the Invention

This invention relates to an image-forming method for forming images having good gloss characteristics and image quality, in printers and copying machines employing a system in which toner images formed by electrophotography are transferred to recording mediums and also the toner images are fixed to the recording medium.

2. Related Background Art

In general, it is well known that silver salt photography and printing have wide color reproduction space and good graininess, gloss uniformity and so forth and hence have a superior image quality. On the other hand, color images formed by electrophotography, though having remarkably been improved in image quality in virtue of digitization in recent years, have not yet achieved so high image quality as the silver salt photography and printing have done.

In full-color images, the gloss characteristics of images contribute greatly to the quality of images. In the silver salt photography and printing, sharp images which are smooth and free of any gloss non-uniformity are obtained by means of the smoothness of paper which is a recording medium, and a color-developing agent of submicrons in particle diameter.

In dry-process electrophotography, in general, electrostatic latent images are formed by means of exposure light on a photosensitive member which is an image-bearing member, the electrostatic latent images are developed with toners of yellow, magenta, cyan and black colors (prepared by mixing colorants such as pigments or dyes in thermoplastic resins) to form toner images, and then the toner images are electrostatically transferred to a recording medium, followed by melt-fixing by applying heat and pressure to form a color (or full-color) image.

In such dry-process electrophotography, usually, toners having particle diameters of from 3 $\mu$m to 12 $\mu$m are used, and it is common to form secondary colors and tertiary colors by the use of four color toners of yellow, magenta, cyan and black which have such particle diameters. Hence, a toner or toners of one color to three colors or four colors are used depending on a color or colors to be reproduced, so that the quantity in which the toner(s) is/are laid on the recording medium (i.e., toner laid-on quantity) may differ part by part. The unevenness of image surface has a tendency of coming small in proportion to the toner laid-on quantity (density) on the recording medium. Hence, where the toner laid-on quantity stands different over the whole image, its glossiness may come non-uniform.

For this reason, in images having a large density gradation as in portrait images, the images have a low gloss at halftone areas (low-density regions) like those of skin and a high gloss at solid areas (high-density regions) like those of hair, giving non-uniform gloss of image and hence a sense of incongruity.

It is also known that any unevenness the surface of such images may have makes them have a low color reproducibility under the influence of irregular reflection from the image surface to provide images having a low sharpness.

Under such circumstances, as disclosed in, e.g., Japanese Patent Application Laid-Open No. 63-92965, a technique is proposed in which, on a transfer material such as paper provided with a transparent resin layer of 50 to 100 $\mu$m thick, color toners with average particle diameter of, e.g., 10 to 15 $\mu$m are superimposed in two to four layers to form color toner images, which are then heated by means of a heat roll to make the color toners melt in the transparent resin layer, followed by fixing to form a color image. As also similarly disclosed in Japanese Patent Application Laid-Open No. 3-38659, a technique is proposed in which, on a transfer material such as paper provided with a transparent resin layer of 10 to 500 $\mu$m thick, and preferably 25 to 300 $\mu$m thick and using color toners with average particle diameter of, e.g., 8 $\mu$m, color toner images are formed, which are then fixed by means of a heat roll to form a color image.

In the techniques disclosed in the above publications, when color toner images are fixed onto a transfer material, the color toner images are pressed by means of a heat roll to heat and melt them and so fix them as to be buried in the transparent resin layer at the transfer material surface so that color images with less surface unevenness can be formed and any illumination light may less irregularly reflect to obtain color images having good quality.

However, in the above method, an oil film is formed between the toners and the transparent resin at the time of fixing, under the influence of a silicone oil which is a release agent, so that the toner images are not sufficiently buried in the transparent resin layer and hence some unevenness remains inevitably.

As also disclosed-in Japanese Patent Application Laid-Open No. 5-216322, a method is proposed in which toner images are electrostatically transferred to a recording medium provided on its surface with a transparent resin layer formed of a thermoplastic resin in a thickness of 20 to 200 $\mu$m, and thereafter the toner images are buried in the transparent resin layer by means of a belt type fixing assembly. In this method, however, even if the toner images and the thermoplastic transparent resin layer are sufficiently melted, they are not sufficiently compatible with each other when melted. Hence, this may cause a lowering of color reproducibility, and may make the image surface remain a little uneven to cause color non-uniformity or narrow the region of color reproduction. This method has such problems.

To solve such problems, Japanese Patent Application Laid-Open No. 11-84719, for example, discloses that images free of any image non-uniformity and having a stable gloss can be obtained by specifying toner laid-on quantity, fixed-image density and image glossiness. This enables formation of high-grade images with less non-uniform gloss in the low-gloss region, but on the other hand has not achieved formation of sufficiently high-grade images in the high-gloss region. Moreover, because of a great difference in glossiness from that of the recording medium itself, there is a problem it gives a sense of incongruity.

SUMMARY OF THE INVENTION

The present invention was made taking account of the above problems. Accordingly, an object of the present invention is to provide an image-forming method which promises a uniform image gloss without relying on the toner laid-on quantity on the recording medium, and can keep images from giving any sense of incongruity between the image gloss and the recording-medium gloss.

To achieve the above object, the present invention provides an image-forming method having at least:

a developing step of developing an electrostatic latent image held on an image-bearing member, by means of a toner to obtain a toner image;

a transfer step of transferring the toner image to a recording medium; and a fixing step of heating the toner image having been transferred onto the recording medium, to fix the former to the latter; and having at least:

a low-speed mode (PS1) in which images are formed at a low speed; and a high-speed mode (PS2) in which images are formed at a high speed;

so as to be able to form images at different speeds;

the recording medium having a gloss value (60-degree gloss) represented by $G_0$ and the toner being laid on the recording medium in a quantity ranging from 0.05 mg/cm$^2$ or more to 1.3 mg/cm$^2$ or less, under conditions of which;

(i) when a recording medium having a high gloss ($G_0$>40) is used, an image is formed at a low-speed mode (PS1) in which the process speed is from 20 mm/sec. or more to less than 130 mm/sec. and, where the maximum value and minimum value of gloss value of the image having been fixed are represented by $G_{max1}$ and $G_{min1}$, respectively, the $G_{max1}$ and the $G_{min1}$ satisfy the following expressions:

$G_{max1} \leqq G_0+40$ and $G_{min1} \geqq G_0-25$; and (ii) when a recording medium having a low gloss ($0 \leqq G_0 \leqq 40$) is used, an image is formed at a high-speed mode (PS2) in which the process speed is from 130 mm/sec. or more to 600 mm/sec. or less and, where the maximum value and minimum value of gloss value of the image having been fixed are represented by $G_{max2}$ and $G_{min2}$, respectively, the $G_{max2}$ and the $G_{min2}$ satisfy the following expressions:

$G_{max2} \leqq G_0+20$ and $G_{min2} \geqq G_0-15$.

The present invention also provides an image-forming method having at least:

a developing step of developing an electrostatic latent image held on an image-bearing member, by means of a toner to obtain a toner image;

a transfer step of transferring the toner image to a recording medium; and a fixing step of heating the toner image having been transferred onto the recording medium, to fix the former to the latter; and having at least:

a low-speed mode (PS1) in which images are formed at a low speed; and a high-speed mode (PS2) in which images are formed at a high speed;

so as to be able to form images at different speeds;

in the fixing step, the relationship between fixing temperature (T1) in the low-speed mode and fixing temperature (T2) in the high-speed mode being:

T2<T1.

DESCRIPTION OF THE PREFERRED EMBODIMENTS

Figure 1:
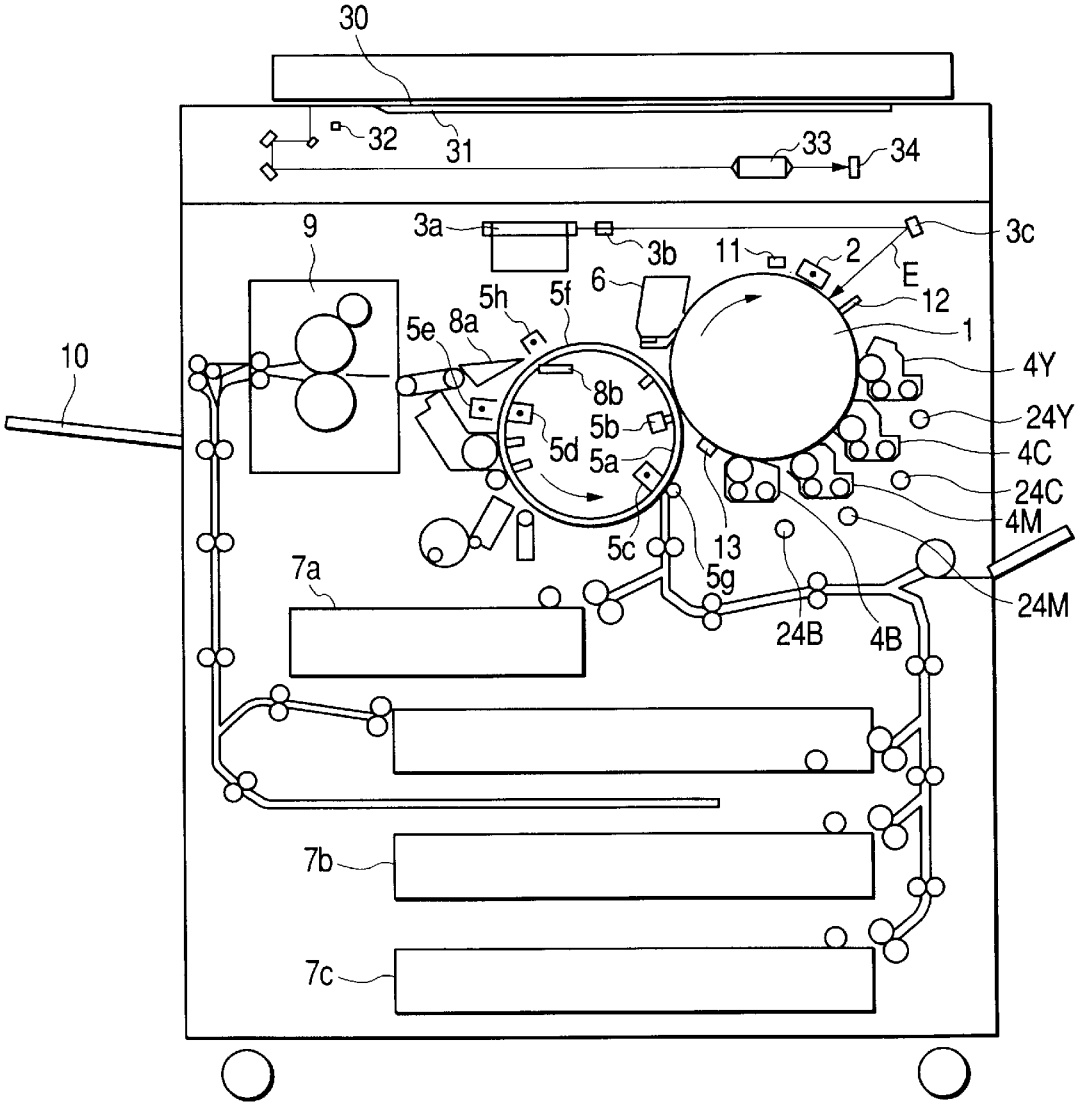
FIG. 1 is a schematic sectional view showing an example of an image-forming apparatus in which the image-forming method of the present invention is applied.

The present invention is described below in detail.

The image-forming method of the present invention has at least a developing step of developing an electrostatic latent image held on an image-bearing member, by means of a toner to obtain a toner image, a transfer step of transferring the toner image to a recording medium, and a fixing step of heating the toner image having been transferred onto the recording medium, to fix the former to the latter; and also has at least a low-speed mode (PS1) in which images are formed at a low speed and a high-speed mode (PS2) in which images are formed at a high speed, so as to be able to form images at different speeds. The recording medium has a gloss value (60-degree gloss) represented by $G_0$ and the toner is laid on the recording medium in a quantity (i.e., toner laid-on quantity) ranging from 0.05 mg/cm$^2$ or more to 1.3 mg/cm$^2$ or less, under conditions of which;

(i) when a recording medium having a high gloss ($G_0$>40) is used, an image is formed at a low-speed mode (PS1) in which the process speed is from 20 mm/sec. or more to less than 130 mm/sec. and, where the maximum value and minimum value of gloss value of the image having been fixed are represented by $G_{max1}$ and $G_{min1}$, respectively, the $G_{max1}$ and the $G_{min1}$ satisfy the following expressions:

$G_{max1} \leqq G_0+40$ and $G_{min1} \geqq G_0-25$; and (ii) when a recording medium having a low gloss ($0 \leqq G_0 \leqq 40$) is used, an image is formed at a high-speed mode (PS2) in which the process speed is from 130 mm/sec. or more to 600 mm/sec. or less and, where the maximum value and minimum value of gloss value of the image having been fixed are represented by $G_{max2}$ and $G_{min2}$, respectively, the $G_{max2}$ and the $G_{min2}$ satisfy the following expressions:

$G_{max2} \leqq G_0+20$ and $G_{min2} \geqq G_0-15$.

The image gloss value may preferably satisfy the following expressions:

$G_{max1} \leqq G_0+30$ and $G_{min1} \geqq G_0-20$; and $G_{max2} \leqq G_0+15$ and $G_{min2} \geqq G_0-15$.

It may more preferably satisfy the following expressions:

$G_{max1} \leqq G_0+25$ and $G_{min1} \geqq G_0-15$; and $G_{max2} \leqq G_0+13$ and $G_{min2} \geqq G_0-13$.

In this case, high-grade fixed images having good color reproducibility and uniform image gloss value can be obtained.

The process speed referred to in the present invention is meant to be the speed in the fixing step, which is the speed at the time the recording medium passes a fixing means.

The toner laid-on quantity of 1.3 mg/cm$^2$ specified in the present invention corresponds substantially to the quantity in which the toner is laid on when a solid image of two colors is formed by development. In usual development, the quantity in which the toner is laid on to the maximum corresponds substantially to this level of quantity. Also, the toner laid-on quantity of 0.05 mg/cm$^2$ corresponds substantially to the quantity in which the toner is laid on when latent images of a very low-density halftone image are developed.

In general, in the course of the fixing of toner images having electrostatically been transferred onto recording mediums in an electrophotographic system, the lower the process speed is or the higher the fixing temperature is, the larger the amount of heat applied to the toner per unit weight is. Hence, the toner can be made to melt sufficiently. Thus, the image surface can have less unevenness and have high image gloss value (G). Also, the image gloss value is greatly influenced by differences in toner laid-on quantity and surface properties of recording mediums.

Accordingly, in the present invention, the process speed and the fixing temperature are controlled so that fixed images having an image gloss value which is suited for the gloss value ($G_0$) of the recording medium can be obtained. To describe this in greater detail; in the present invention, images are formed making the process speed low when a high-gloss paper (recording medium) is used and making the process speed high when a low-gloss paper (recording medium) is used, even in either of the case in which a low-gloss recording medium is used and the case in which a high-gloss recording medium is used, in order that the gloss of the recording medium and the gloss of the fixed images do not differ greatly in forming images which range from very low-density halftone images to high-density solid images.

If the process speed is less than 20 mm/sec., where the fixing temperature is set to a usual temperature, the heat is applied to the toner in an excess amount, and hence, for example, the recording medium may wind around the fixing roller to make it difficult to perform fixing. Also, where the fixing temperature is set to a temperature low enough to enable prevention of such winding, the toner may not sufficiently be melted to result in a very poor color reproducibility, and further to cause low-temperature offset.

If on the other hand the process speed is more than 600 mm/sec., the heat is not applied to the toner in a sufficient amount even when the fixing temperature is made higher, to make it difficult to perform fixing. Here, in order to perform sufficiently good fixing, the process speed may preferably be 400 mm/sec. or less.

The process speed in the low-speed mode (PS1) may also preferably be ¼ to ½ of the process speed in the high-speed mode (PS2).

In the present invention, as a heating member used in the fixing step, a roller having an elastic layer formed on a substrate is preferable. As the elastic layer, it is preferable to use an elastic layer having an Asker-C hardness of from 50 to 90 and a thickness of from 0.5 mm to 5 mm, and more preferably an Asker-C hardness of from 60 to 80 and a thickness of from 0.5 mm to 4 mm. The hardness this heating member has can make the image surface have less unevenness when the toner images laid on the recording medium are fixed, and makes it possible to perform fixing not following the surface properties of the recording medium itself, so that the image gloss value can well be made uniform.

An elastic layer having an Asker-C hardness of less than 50 is undesirable because any unevenness may remain at the image surface to make it impossible to obtain uniform gloss. If on the other hand the elastic layer has a thickness of less than 0.5 mm, it may greatly be influenced by the surface properties of the recording medium, so that any high-quality images can not be obtained.

The heating member may also preferably have a surface layer on the elastic layer. As the surface layer, it may preferably be a fluorine resin layer with a layer thickness of from 10 $\mu$m to 100 $\mu$m in view of the releasability and strength of fixed images. In addition, the surface layer may preferably have an average surface roughness (Ra) of 2 $\mu$m or less in order to improve the smoothness of the image surface.

In the present invention, the fixing temperature in the high-speed mode (PS2) may preferably be from 140° C. to 200° C., and more preferably be from 150° C. to 190° C. In the low-speed mode (PS1), the fixing temperature may preferably be from 150° C. to 210° C., and more preferably be from 160° C. to 200° C.

The image-forming method of the present invention is specifically a method which fulfills the following conditions.

In the present invention, where the toner laid-on quantity on the recording medium ranges from 0.05 mg/cm$^2$ or more to 1.3 mg/cm$^2$ or less;

(i) when a transfer paper having $G_0$ of 50 (basis weight: 148 g/m$^2$) is used as the recording medium and an image is formed by fixing performed at a fixing temperature of 170° C. in a low-speed mode (PS1) in which the process speed is 60 mm/sec., the maximum value $G_{max1}$ and minimum value $G_{min1}$ of gloss value of the image having been fixed satisfy:
$G_{max1} \leqq 90$ and $G_{min1} \geqq 25$;
preferably;
$G_{max1} \leqq 80$ and $G_{min1} \geqq 30$; and
more preferably;
$G_{max1} \leqq 75$ and $G_{min1} \geqq 35$; and also (ii) when a transfer paper having $G_0$ of 2 (basis weight: 81.4 g/m$^2$) is used and an image is formed by fixing performed at a fixing temperature of 160° C. in a high-speed mode (PS2) in which the process speed is 250 mm/sec., the maximum value $G_{max2}$ and minimum value $G_{min2}$ of gloss value of the image having been fixed satisfy:
$G_{max2} \leqq 22$ and $G_{min2} \geqq 0$;
preferably;
$G_{max2} \leqq 17$ and $G_{min2} \geqq 0$; and
more preferably;
$G_{max2} \leqq 15$ and $G_{min2} \geqq 0$.

In addition, in the present invention, in view of image characteristics such as color reproducibility, graininess and gloss uniformity, the image density ($D_{0.5}$) after fixing, at the time the toner laid-on quantity on the recording medium is 0.5 mg/cm$^2$ may preferably be:

(i) 1.2 or more when the image is formed in the low-speed mode (20 mm/sec. or more to less than 130 mm/sec.); and (ii) 1.0 or more when the image is formed in the high-speed mode (130 mm/sec. or more to 600 mm/sec. or less).

When the toner has such coloring power, more high-grade images can be obtained.

Where $D_{0.5}<1.2$ at the time of the low-speed mode or $D_{0.5}<1.0$ at the time of the high-speed mode, it means that the toner has a low coloring power, and a problem of low density at solid areas tends to arise. Where the toner quantity on the transfer material is made larger in an attempt to eliminate such a problem, it follows that the quantity of the toner consumed in image reproduction is made larger to make it necessary to replenish the toner frequently into a developing assembly. This not only is disadvantageous in cost, but also makes it hard to agitate a color toner and a carrier uniformly in the developing assembly, tending to cause non-uniformity on images when solid images are reproduced, to make it hard to obtain uniform solid images.

In general, when treatment is made under the same conditions for fixing speed, fixing temperature, fixing pressure and so forth to fix unfixed images on different recording mediums, the heat to be furnished to the fixing of unfixed images may inevitably be taken away by the recording medium depending on its weight (thickness) and difference in material, resulting in a difference in fixing performance. Accordingly, it is common to perform the fixing in a low-speed mode in the case of recording mediums requiring a large heat capacity (such as cardboards), and conversely to perform the fixing in a high-speed mode in the case of recording mediums requiring a small heat capacity (such as plain paper).

Accordingly, in the fixing step in the present invention, having at least the low-speed mode (PS1) and the high-speed mode (PS2), in order to obtain high-quality images which accord with the glossiness of the recording medium, the relationship between fixing temperature T1 (° C.) in the low-speed mode and fixing temperature T2(° C.) in the high-speed mode may preferably be:

$T2<T1$; and more preferably satisfy:

$T2 \leqq T1-5$.

Any relationship of $T2 \geqq T1$ of the fixing temperature is undesirable because, in the high-speed mode, the amount of heat to be applied is so large that a too high glossiness may result, and on the other hand in the low-speed mode, a very low glossiness may result to give unnatural images.

The toner used in the present invention contains a binder resin. There are no particular limitations on the binder resin. As a binder resin for full-color toners, a low-molecular-weight binder resin having sharp-melt properties is preferred because the toners are required to have good color reproducibility and provide good transparency of overhead projector (OHP) images, and also to color-mix well between toners in the fixing step.

As a specific resin, it may preferably be a resin selected from any of (a) a polyester resin, (b) a hybrid resin having a polyester unit and a vinyl polymer unit, (c) a mixture of the hybrid resin and a vinyl polymer, (d) a mixture of the polyester resin and a vinyl polymer and (e) a mixture of the hybrid resin and the polyester resin.

In the case when a polyester type resin is used, alcohols and carboxylic acids or carboxylic anhydrides or carboxylates may be used as material monomers. Stated specifically, as a dihydric alcohol component, it may include, e.g., bisphenol-A alkylene oxide addition products represented by the following Formula (1):

(1)

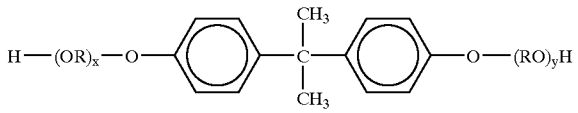

wherein R represents an ethylene group or a propylene group, x and y are each an integer of 1 or more, and an average value of x+y is 2 to 10;

such as polyoxypropylene(2.2)-2,2-bis(4-hydroxyphenyl)propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2, 2-bis(4-hydroxyphenyl)propane and polyoxypropylene (6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As an acid component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof.

In particular, a polyester resin obtained by using as a diol component a bisphenol derivative represented by the above Formula (1) and as an acid component a carboxylic acid component comprised of a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid) and performing polycondensation of these components is preferred because it affords a good charging performance as color toners.

In the binder resin contained in the toner used in the present invention, the "hybrid resin" is meant to be a resin in which vinyl copolymer units and polyester units have chemically been bonded. Stated specifically, it is formed by ester exchange reaction of a polyester unit with a vinyl polymer unit made up by polymerizing a monomer having a carboxylate group such as acrylate or methacrylate, which may preferably form a graft copolymer (or block copolymer) comprised of vinyl polymer unit as the backbone polymer and the polyester unit as the branch polymer.

As a vinyl monomer for forming the vinyl polymer-unit, it may include the following: Styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include un-saturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, and alkenyladipic acids.

It may still further include monomers having a hydroxyl group as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl) styrene.

In the toner used in the present invention, the vinyl polymer unit of the binder resin may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl) propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

In the present invention, the vinyl polymer component and/or the polyester resin component may preferably be incorporated with a monomer component capable of reacting with the both resin components. Among monomers constituting the polyester resin component, a monomer component capable of reacting with the vinyl polymer component may include, e.g., unsaturated dicarboxylic acids such as fumaric acid, maleic acid, citraconic acid and itaconic acid, or anhydrides thereof. Among monomers constituting the vinyl polymer component, a monomer component capable of reacting with the polyester resin component may include monomers having a carboxyl group or a hydroxyl group, and acrylates or methacrylates.

As a method for obtaining the reaction product of the vinyl polymer component with the polyester resin component, preferred is a method in which, in the state a polymer containing a monomer component capable of respectively reacting with the vinyl polymer component and the polyester resin component is present, polymerization reaction for any one or both of the resins is carried out.

As a polymerization initiator used when the vinyl polymer according to the present invention is produced, it may include, e.g., azo or diazo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexane-1-carbonitrile), 2-(carbamoylazo) isobutyronitrile, 2,2'-azobis-(2,4,4-trimethylpentane), 2-phenylazo-2,4-dimethyl-4-methoxyvaleronitrile and 2,2'-azobis-(2-methyl-propane); and ketone peroxides such as methyl ethyl ketone peroxide, acetylacetone peroxide and cylcohexanone peroxide; as well as 2,2-bis(t-butylperoxy) butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

As methods by which a binder resin containing the hybrid resin as the binder resin used in the toner used in the present invention can be produced may include, e.g., the following production methods shown in (1) to (6).

(1) A method of blending a vinyl polymer, a polyester resin and a hybrid resin after they have independently be produced. These may be blended by dissolving and swelling them in an organic solvent (e.g., xylene), followed by evaporation of the organic solvent. As the hybrid resin, an ester compound may be used which is synthesized by separately producing a vinyl polymer and a polyester resin, and thereafter dissolving and swelling them in a small amount of organic solvent, followed by addition of an esterifying catalyst and an alcohol and then heating to effect ester exchange reaction.

(2) A method of first producing a vinyl polymer unit and thereafter producing a polyester unit and a hybrid resin in the presence of the vinyl polymer unit. The hybrid resin is produced by reacting, as components, the vinyl polymer unit (a vinyl monomer may also optionally be added) with a polyester monomer (alcohol or carboxylic acid) and/or a polyester as the polyester unit. In this case, too, any organic solvent may appropriately be used.

(3) A method of first producing a polyester unit and thereafter producing a vinyl polymer unit and a hybrid resin in the presence of the polyester unit. The hybrid resin is produced by reacting the polyester unit (a polyester monomer may also optionally be added) with a vinyl monomer and/or the vinyl polymer unit.

(4) A vinyl polymer unit and a polyester unit are first produced and thereafter a vinyl monomer and/or a polyester monomer (alcohol or carboxylic acid) is/are added in the presence of these polymer units to produce a hybrid resin. In this case, too, any organic solvent may appropriately be used.

(5) A hybrid resin is first produced and thereafter a vinyl monomer and/or a polyester monomer (alcohol or carboxylic acid) is/are added to effect addition polymerization and/or polycondensation reaction to produce the hybrid resin comprised of a vinyl polymer unit and a polyester unit. In this case, as the hybrid resin component, any of the hybrid resins produced by the above methods (2) to (4) may be used, or optionally a hybrid resin produced by any conventional method may also be used. Also, any organic solvent may appropriately be used.

(6) A vinyl monomer and a polyester monomer (alcohol or carboxylic acid) are mixed to effect addition polymerization and polycondensation reaction continuously to produce a vinyl polymer unit, a polyester unit and a hybrid resin. Also, any organic solvent may appropriately be used.

In the above production processes (1) to (4), a plurality of polymer units having different molecular weights and different degrees of cross-linking may be used as the vinyl polymer unit and/or the polyester unit.

The toner used in the present invention may have, in its viscoelasticity characteristics, a storage elastic modulus at a temperature of 80° C., $G'_{80}$, within the range of from $1\times10^6$ to $1\times10^8$ dN/m$^2$, and preferably from $1\times10^6$ to $5\times10^7$ dN/m$^2$, in order to improve its storage stability, heat resistance and anti-blocking properties in a high-temperature environment. If the toner has a storage elastic modulus $G'_{80}$ of less than $1\times10^6$ dN/m$^2$, it may have inferior storage stability, heat resistance and anti-blocking properties in a high-temperature environment, so that toner particles may coalesce one another to form large agglomerates of toner undesirably. In recent years, copying machines and printers are being made high-speed for their output speed and being made compact in body size, and hence they have a tendency toward higher in-machine temperature. Accordingly, in order to stably obtain images with high minuteness and high image quality, it is important for toners to have sufficient storage stability, heat resistance and anti-blocking properties in a high-temperature environment. Also, if the toner has a storage elastic modulus $G'_{80}$ of more than $1\times10^8$ dN/m$^2$, it can have sufficient storage stability, heat resistance and anti-blocking properties, but may have no sufficient fixing performance at low-temperature undesirably.

The toner used in the present invention may also preferably have a storage elastic modulus at a temperature of from 120° C. to 180° C. having a minimum value $G'_{min}$ and a maximum value $G'_{max}$, each being within the range of from $5\times10^3$ to $1\times10^6$ dN/m$^2$, and more preferably from $1\times10^4$ to $5\times10^5$ dN/m$^2$, in order to achieve both sufficient low-temperature fixing performance and sufficient high-temperature anti-blocking properties. If the toner has a storage elastic modulus at a temperature of from 120° C. to 180° C. of less than $5\times10^3$ dN/m$^2$ as the minimum value $G'_{min}$, the toner can not have any sufficient high-temperature anti-blocking properties undesirably. Also, if the toner has a storage elastic modulus at a temperature of from 120° C. to 180° C. of more than $1\times10^6$ dN/m$^2$ as the maximum value $G'_{max}$, the toner can not have any sufficient low-temperature fixing performance undesirably.

In addition, the toner used in the present invention exhibits much better anti-blocking properties when the storage elastic modulus at a temperature of from 120° C. to 180° C. has a minimum value $G'_{min}$ and a maximum value $G'_{max}$ in a ratio $G'_{max}/G'_{min}$ of 20 or less. If the ratio $G'_{max}/G'_{min}$ is more than 20, fixed images may have a different gloss depending on the fixing temperature. This is undesirable in view of stable formation of images in a high grade when images are reproduced in a large quantity. The ratio $G'_{max}/G'_{min}$ may more preferably be 15 or less.

The toner used in the present invention may preferably contain at least one type of wax.

As examples of the wax used in the present invention, it may include the following: Aliphatic hydrocarbon waxes such as low-molecular weight polyethylene, low-molecular weight polypropylene, microcrystalline wax and paraffin wax, oxides of aliphatic hydrocarbon waxes, such as polyethylene oxide wax, or block copolymers of these; waxes composed chiefly of a fatty ester, such as carnauba wax, sazol wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or acrylic acid to fatty acid hydrocarbon waxes; partially esterified products of polyhydric alcohols with fatty acids, such as monoglyceride behenate; and methyl esterified product having a hydroxyl group, obtained by hydrogenation of vegetable fats and oils.

Waxes particularly preferably usable in the present invention may include aliphatic hydrocarbon waxes. For example, they may be low-molecular weight alkylene polymers obtained by polymerizing alkylenes by radical polymerization under high pressure or by polymerization under low pressure in the presence of a Ziegler catalyst, alkylene polymers obtained by thermal decomposition of high-molecular weight alkylene polymers, and synthetic hydrocarbon waxes obtained from, or by hydrogenation of, distillation residues of hydrocarbons obtained by the Arge process from synthetic gases comprised of carbon monoxide and hydrogen. Hydrocarbon waxes fractionated by using press sweating, solvent fractionation or vacuum distillation, or by a fractionation recrystallization system may more preferably be used.

The hydrocarbons, serving as a matrix, may include those synthesized by reacting carbon monoxide with hydrogen in the presence of a metal oxide type catalyst (usually catalysts of a two or more multiple system), as exemplified by hydrocarbon compounds synthesized by the Synthol method or the Hydrocol process (making use of a fluidized catalyst bed); hydrocarbons having about several-hundred carbon atoms obtained by the Arge process (making use of a fixed catalyst bed) which can obtain waxy hydrocarbons in a large quantity; and hydrocarbons obtained by polymerization of alkylenes such as ethylene in the presence of a Ziegler catalyst; all of which are preferable as having less and small branches and being saturated long straight chain hydrocarbons. In particular, waxes synthesized by the method not relying on the polymerization of alkylenes are preferred in view of their molecular weight distribution.

The wax may preferably have, in its molecular weight distribution, a main peak in the range of molecular weight of from 400 to 2,400, and more preferably in the range of molecular weight of from 430 to 2,000. Waxes made to have such a molecular weight distribution can endow the toner with preferable thermal properties.

In order to make the toner function more effectively at the time of fixing, the wax may preferably have a melting point of from 60° C. to 100° C., and more preferably from 65° C. to 90° C.

The wax may be used in an amount of from 0.1 to 20 parts by weight, and preferably from 0.5 to 10 parts by weight, based on 100 parts by weight of the binder resin.

The wax may usually be incorporated into the toner by a method in which the binder resin is dissolved in a solvent and the binder resin solution formed is heated, where the wax is added and mixed with stirring, or a method in which the wax is mixed at the time of kneading of the binder resin.

From the viewpoint of achievement of both the low-temperature fixing performance and the high-temperature anti-blocking properties, the toner used in the present invention may also preferably have, in the endothermic curve in the range of temperature of from 30° C. to 200° C. in the measurement by differential thermal analysis (or differential scanning calorimetry DSC), a peak temperature of a maximum endothermic peak within the range of temperature of from 50° C. to 110° C., and more preferably within the range of from 60° C. to 90° C. If the maximum peak of the endothermic curve is higher than 110° C., the toner may have a low fixing performance. If on the other hand the maximum peak of the endothermic curve is lower than 50° C., the toner tends to have poor anti-blocking properties.

The toner used in the present invention may preferably have a weight-average particle diameter of from 4 to 10 μm, and more preferably from 5 to 9 μm. The toner used in the present invention may also preferably have a number-average particle diameter of from 3.5 to 9.5 μm, contain particles of 4 μm or smaller in toner's number distribution in an amount of from 5 to 50% by number, and contain particles of 12.70 μm or larger in volume distribution in an amount not more than 5% by volume.

If the toner has a weight-average particle diameter larger than 10 μm, it means that the fine particles contributory to the achievement of high image quality are in a small quantity. This on the one hand brings about an advantage that a high image density can be attained with ease and the toner can have a superior fluidity, but on the other hand the toner may be hard to adhere to the fine electrostatically charged image (electrostatic latent image) on the photosensitive drum, resulting in a low reproducibility at highlight areas and also resulting in a low resolution. Also, the toner may be laid on the electrostatically charged image in excess to tend to cause an increase in toner consumption.

If on the other hand the toner has a weight-average particle diameter smaller than 4 μm, the toner may have a high charge quantity per unit weight to cause a decrease in image density, and markedly cause a decrease in image density especially in an environment of low temperature and low humidity. If so, the toner may be unsuitable especially for the use to form images having a high image area percentage, such as graphic images.

In addition, if the toner has a weight-average particle diameter smaller than 4 μm, its contact charging with charge-providing members such as a carrier may be performed with difficulty, so that any toner not well chargeable may become large in proportion to cause fog conspicuously which is due to toner scatter on non-image areas. To cope with this problem, it may be considered to make carrier's particle diameter smaller in order to gain the specific surface area of the carrier. However, the toner having such a weight-average particle diameter smaller than 4 μm tends to also cause self agglomeration, and it may be difficult for the toner to be uniformly blended with the carrier in a short time, tending to cause fog during running performed supplying the toner continuously.

The toner used in the present invention may also preferably contain toner particles of 4 μm or smaller in particle diameter in an amount of from 5 to 50% by number, and more preferably from 5 to 25% by number, of the number of all particles. If it contains the toner particles of 4 μm or smaller in particle diameter in an amount smaller than 5% by number, it means that the fine toner particles serving as a component essential for high image quality are in a small quantity. Hence, especially as the toner is continuously consumed by continuous copying or printing, any effective toner particle component may decrease to ill balance the toner's particle size distribution prescribed in the present invention, tending to cause a gradual lowering of image quality.

If on the other hand it contains the toner particles of 4 μm or smaller in particle diameter in an amount larger than 50% by number, toner particles tend to agglomerate mutually to come to often behave as toner masses larger in diameter than the original particle diameter. As the result, coarse images tend to be formed, resulting in a low resolution, or the electrostatically charged image may have a great difference in density between its edges and interiors, tending to form images with a little blank areas. In view of an improvement in image quality, the toner used in the present invention may more preferably contain toner particles of 12.70 μm or larger in particle diameter in an amount not more than 7% by volume.

As colorants for color toners used in the present invention, known dyes and/or pigments may be used.

Color pigments for a magenta toner may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Vat Red 1, 2, 10, 13, 15, 23, 29, 35.

The pigments may be used alone, or dyes may be used in combination with such pigments so that color sharpness can be improved. This is preferable in view of image quality of full-color images.

Dyes for the magenta toner may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Color pigments for a cyan toner may include C.I. Pigment Blue 2, 3, 15, 16, 17, C.I. Vat Blue 6, C.I. Acid Blue 45, or copper phthalocyanine pigments whose phthalocyanine skeleton has been substituted with 1 to 5 phthalimide methyl group(s).

Color pigments for a yellow toner may include C.I. Pigment Yellow 1, 2, 3, 4, 5, 6, 7, 10, 11, 12, 13, 14, 15, 16, 17, 23, 65, 73, 83, 97, 155, 180, and C.I. Vat Yellow 1, 3, 20.

Dyes such as C.I. Direct Green 6, C.I. Basic Green 4, C.I. Basic Green 6 and C.I. Solvent Yellow 162 may also be used.

As black colorants used in the present invention, usable are carbon black, magnetic materials and those toned in black using the yellow, magenta and cyan colorants shown above.

Any of the colorants may preferably be used in an amount of from 0.1 to 15 parts by weight, more preferably from 0.5 to 12 parts by weight, and most preferably from 2 to 10 parts by weight, based on 100 parts by weight of the binder resin.

The toner used in the present invention may be incorporated with a charge control agent. As the charge control agent, an organometallic compound may preferably be used, and an organometallic compound of an aromatic carboxylic acid with a divalent or higher metal is preferred.

The aromatic carboxylic acid may include the following three types of compounds.

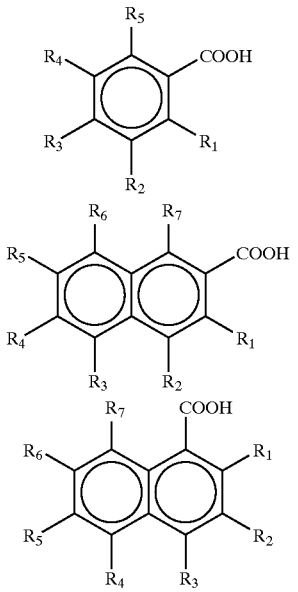

wherein $R_1$ to $R_7$ represent groups which may be the same or different, and each represent a hydrogen atom, an alkyl group having 1 to 12 carbon atoms, an alkenyl group having 2 to 12 carbon atoms, —OH, $—NH_2$, $—NH(CH_3)$, $—N(CH_3)_2$, $—OCH_3$, $—O(C_2H_5)$, —COOH or $—CONH_2$.

Preferred groups represented by $R_1$ may include a hydroxyl group, an amino group and a methoxyl group. In particular, a hydroxyl group is preferred. The aromatic carboxylic acid may particularly preferably be a dialkylsalicylic acid such as di-tert-butylsalicylic acid.

As metals that form such organometallic compounds, divalent or higher metallic atoms are preferred. Divalent metals may include $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$. As the divalent metals, $Zn^{2+}$, $Ca^{2+}$, $Mg^{2+}$ and $Sr^{2+}$ are preferred. Trivalent or higher metals may include $Al^{3+}$, $Cr^{3+}$, $Fe^{3+}$ and $Ni^{3+}$. Of these metals, preferred are $Al^{3+}$, $Fe^{3+}$, $Cr^{3+}$ and $Zn^{2+}$, and particularly preferred is $Al^{3+}$.

In the present invention, an aluminum compound of di-tert-butylsalicylic acid and a zinc compound of di-tert-butylsalicylic acid are preferred as the organometallic compound.

The metal compound of an aromatic carboxylic acid derivative may be synthesized by, e.g., dissolving the aromatic carboxylic acid in an aqueous sodium hydroxide solution, adding dropwise to the aqueous sodium hydroxide solution an aqueous solution in which a divalent or higher metal atom has been melted, heating and stirring the solution, then adjusting its pH, and cooling the solution to room temperature, followed by filtration and water washing to obtain a metal compound of the aromatic carboxylic acid derivative. However, the method is by no means limited only to such a synthesis method.

The organometallic compound may preferably be used in an amount of 10 parts by weight or less, preferably 7 parts by weight or less, and more preferably from 0.05 to 5 parts by weight, based on 100 parts by weight of the binder resin. This is preferable in view of the viscoelastic properties and charging performance of the toner.

In the toner used in the present invention, in addition to the above organometallic compound, any known compound used as a charge control agent may be used as the charge control agent in order to make its charging performance more stable.

In view of an improvement in image quality and in view of storage stability in a high-temperature environment, the toner used in the present invention may still more preferably have a fluidity improver added externally. The fluidity improver may preferably be an inorganic fine power such as fine silica powder, fine titanium oxide powder or fine aluminum oxide powder. Such an inorganic fine power may preferably be one having been made hydrophobic with a hydrophobic-treating agent such as a coupling agent, a silicone oil or a mixture of these.

The hydrophobic-treating agent may include coupling agents such as a silane coupling agent, a titanate coupling agent, an aluminum coupling agent and a zircoaluminate coupling agent.

Stated specifically, the silane coupling agent may preferably be a compound represented by the following general formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3.

Such a compound may include, e.g., vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

What is particularly preferred in the present invention is an alkylalkoxysilane coupling agent represented by the general formula:

$$C_nH_{2n+1}—Si—(OC_mH_{2m+1})_3$$

wherein n represents an integer of 4 to 12, and m represents an integer of 1 to 3.

In the alkylalkoxysilane coupling agent, if n is smaller than 4, though hydrophobic treatment may be made with ease, a low hydrophobicity may result undesirably. If on the other hand n is larger than 12, though hydrophobicity can be sufficient, fine powder particles may greatly coalesce one another to tend to have a low fluidity-providing ability. If m is larger than 3, the alkylalkoxysilane coupling agent may have a low reactivity to make it hard for the inorganic fine powder to be made well hydrophobic. Accordingly, in the alkylalkoxysilane coupling agent, n may preferably be from 4 to 8, and m may preferably be 1 or 2.

In the treatment, the coupling agent may be used in an amount of from 1 to 60 parts by weight, and preferably from 3 to 50 parts by weight, based on 100 parts by weight of the inorganic fine power.

The hydrophobic treatment may be made using one kind of hydrophobic-treating agent alone, or using two or more kinds of hydrophobic-treating agents. For example, the hydrophobic treatment may be made using one kind of coupling agent alone or using two kinds of coupling agents simultaneously, or the hydrophobic treatment may be made first using one coupling agent and thereafter further using another coupling agent.

The fluidity improver may preferably be added in an amount of from 0.01 to 5 parts by weight, and more preferably from 0.05 to 3 parts by weight, based on 100 parts by weight of the toner particles.

Where a two-component developer containing toner particles and a carrier is used in the image-forming method of the present invention, usable as the carrier are particles of metals such as iron, nickel, copper, zinc, cobalt, manganese, chromium and rare earth elements, which may be surface-oxidized or unoxidized, alloys or oxides of any of these, and ferrite.

In particular, an Mn—Mg—Fe three-element magnetic ferrite particles formed of manganese, magnesium and iron components as chief components are preferred as carrier particles. In a resin-coated carrier, surface-coated with a resin, a silicone resin may be used as the coating resin. In such a case, the Mn—Mg—Fe three-element magnetic ferrite particles may particularly preferably have the silicon element in an amount of from 0.001 to 1% by weight, and more preferably from 0.005 to 0.5% by weight.

Such magnetic carrier particles may preferably be those having been coated with a resin. As the resin, silicone resins are preferred. In particular, a nitrogen-containing silicone resin or a modified silicone resin formed by the reaction of a nitrogen-containing silane coupling agent with a silicone resin is preferred in view of the providing of negative triboelectric charges to the color toners used in the present invention, the environmental stability of the toners and the prevention of carrier particle surfaces from contamination.

Such a magnetic carrier may preferably have an average particle diameter of from 15 to 60 μm, and more preferably form 25 to 50 μm, in relation to the weight-average particle diameter of the color toners.

The average particle diameter and particle size distribution of the magnetic carrier may be measured using a laser diffraction particle size distribution measuring device HELOS (trade name; manufactured by Nippon Denshi K.K.) in combination with a dry-dispersion unit RODOS (trade name; manufactured by Nippon Denshi K.K.). Samples are measured under measurement conditions of a lens focal length of 200 mm, a dispersion pressure of 3.0 bar and a measurement time of 1 second to 2 seconds, dividing the range of particle diameter of from 0.5 μm to 350.0 μm into 31 channels as shown in Table 1 below. The 50% particle diameter (median diameter) based on volume distribution is determined as the average particle diameter and also determined the percent (%) by volume of particles within each particle diameter range from volume-based frequency distribution.

TABLE 1

| Particle diameter ranges (μm) |
|---|
| ≧0.5–<1.8 |
| ≧1.8–<2.2 |
| ≧2.2–<2.6 |
| ≧2.6–<3.0 |
| ≧3.0–<3.6 |
| ≧3.6–<4.4 |
| ≧4.4–<5.2 |
| ≧5.2–<6.2 |
| ≧6.2–<7.4 |
| ≧7.4–<8.6 |
| ≧8.6–<10.0 |
| ≧10.0–<12.0 |
| ≧12.0–<15.0 |
| ≧15.0–<18.0 |
| ≧18.0–<21.0 |
| ≧21.0–<25.0 |
| ≧25.0–<30.0 |
| ≧30.0–<36.0 |
| ≧36.0–<42.0 |
| ≧42.0–<50.0 |
| ≧50.0–<60.0 |
| ≧60.0–<72.0 |
| ≧72.0–<86.0 |
| ≧86.0–<102.0 |
| ≧102.0–<122.0 |
| ≧122.0–<146.0 |
| ≧146.0–<174.0 |
| ≧174.0–<206.0 |
| ≧206.0–<246.0 |
| ≧246.0–<294.0 |
| ≧294.0–<350.0 |

The laser diffraction particle size distribution measuring device HELOS used in measuring the particle size distribution is a device which makes measurement by using the Furanhofer diffraction theory. To explain this theory briefly, upon irradiation of measuring particles by laser beams from a laser light source, a diffraction image is formed on a focal plane on the side opposite to the laser light source, and the diffraction image is detected by means of a detector, followed by arithmetic operation to calculate the particle size distribution of the measuring particles.

As a method for adjusting the magnetic carrier so as to have the above average particle diameter and specific particle size distribution, for example a sieve may be used to make classification. In order to make the classification especially in a good precision, carrier particles may preferably be sieved several times repeatedly, using a sieve having a suitable mesh size. It is also an effective means to use a sieve whose mesh opening shape has been controlled by plating or the like.

When blended with a color toner to prepare the two-component developer, good results are obtainable where the toner and the carrier are blended in such a proportion that the toner in the developer is in a concentration of from 2 to 15% by weight, and preferably from 4 to 13% by weight. If the toner is in a concentration of less than 2% by weight, a low image density tends to result. If it is in a concentration of more than 15% by weight, fog and in-machine toner scatter tend to occur.

A method of forming full-color images by the image-forming method of the present invention is described below with reference to FIG. 1.

FIG. 1 schematically illustrates the constitution of an example of an image forming apparatus for forming full-color images by electrophotography. The image forming apparatus shown in FIG. 1 is used as a full-color copying machine or a full-color printer. It has a digital color-image reader section at the top and a digital color-image printer section at a lower part.

In the image reader section, an original 30 is placed on an original-setting glass 31, and an exposure lamp 32 is put into exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the digital image printer section, a photosensitive drum 1 as an image-bearing member has a photosensitive layer having, e.g., an organic photoconductor, and is supported rotatably in the direction of an arrow. Around the photosensitive drum 1, a pre-exposure lamp 11, a corona charging assembly 2, a laser exposure optical system 3 (3*a*, 3*b*, 3*c*), a potential sensor 12, four different color developing assemblies 4Y, 4C, 4M and 4B, a detecting means 13 for detecting the amount of light on the drum, a transfer assembly 5 (5*a* to 5*h*) and a cleaner 6 are provided.

In the laser exposure optical system, the image signals sent from the reader section are converted into optical signals for image scanning exposure in a laser output section (not shown), and the laser light thus converted is reflected on a polygonal mirror 3*a* and projected on the surface of the photosensitive drum 1 through a lens 3*b* and a mirror 3*c*.

In the printer section, the photosensitive drum 1 is rotated in the direction of the arrow at the time of image formation. The photosensitive drum 1 is, after destaticized by the pre-exposure lamp 11, uniformly negatively charged by means of the charging assembly 2, and then irradiated with an optical image F for each separated color to form an electrostatic image on the photosensitive drum 1.

Next, a stated developing assembly is operated to develop the electrostatic image formed on the photosensitive drum 1 to form a toner image on the photosensitive drum 1 by the use of a toner. The developing assemblies 4Y, 4C, 4M and 4B come close to the photosensitive drum 1 in an alternative way in accordance with the respective separated colors by the operation of eccentric cams 24Y, 24C, 24M and 24B, respectively, to perform development.

The transfer assembly has a transfer drum 5*a*, a transfer charging assembly 5*b*, an attraction charging assembly 5*c* for electrostatically attracting a transfer material serving as the recording medium, and an attraction roller 5*g* provided opposingly to the assembly 5*c*, and also an inside charging assembly 5*d*, an outside charging assembly 5*e* and a separation charging assembly 5*h*. The transfer drum 5*a* is supported on a shaft so that it can be rotatably driven, and has a transfer sheet 5*f* serving as a transfer material holding member that holds the recording medium (transfer material) at an open zone on the periphery thereof, the transfer sheet being provided on a cylinder under integral adjustment. As the transfer sheet 5*f*, a resin film such as polycarbonate film is used.

The transfer material is transported from a cassette 7*a*, 7*b* or 7*c* to the transfer drum 5*a* through a transfer sheet transport system, and is held on the transfer drum 5*a*. With the rotation of the transfer drum 5*a*, the transfer material held on the transfer drum 5*a* is repeatedly transported to the transfer position facing the photosensitive drum 1. In the course where it passes the transfer position, the toner image formed on the photosensitive drum 1 is transferred to the transfer material by the action of the transfer charging assembly 5*b*.

The toner image may directly be transferred from the photosensitive member to the transfer material, or the toner image on the photosensitive member may be transferred to an intermediate transfer member and the toner image may be transferred from the intermediate transfer member to the transfer material.

The above steps of image formation are repeatedly carried out on yellow (Y), magenta (M), cyan (C) and black (B), thus a color image formed by superimposing four color toner images is obtained on the transfer material held on the transfer drum 5*a*.

The transfer material to which the four color toner images have been thus transferred is separated from the transfer drum 5*a* by the action of a separation claw 8*a*, a separation push-up roller 8*b* and the separation charging assembly 5*h*, and sent to a heat-and-pressure fixing assembly 9, where the toner images are fixed by heating and pressing and thereby the color mixing of the toners, color formation, and fixing to the transfer material are performed until a full-color fixed image is formed. Thereafter, the transfer material having the fixed image thus formed is put out to a tray 10. Thus, the formation of a full-color image is completed.

In the image-forming method of the present invention, it may be so constructed that the gloss value of the recording medium fed is measured with a detector and the process speed is automatically adjusted on the basis of the gloss value thus measured.

Figure 2:
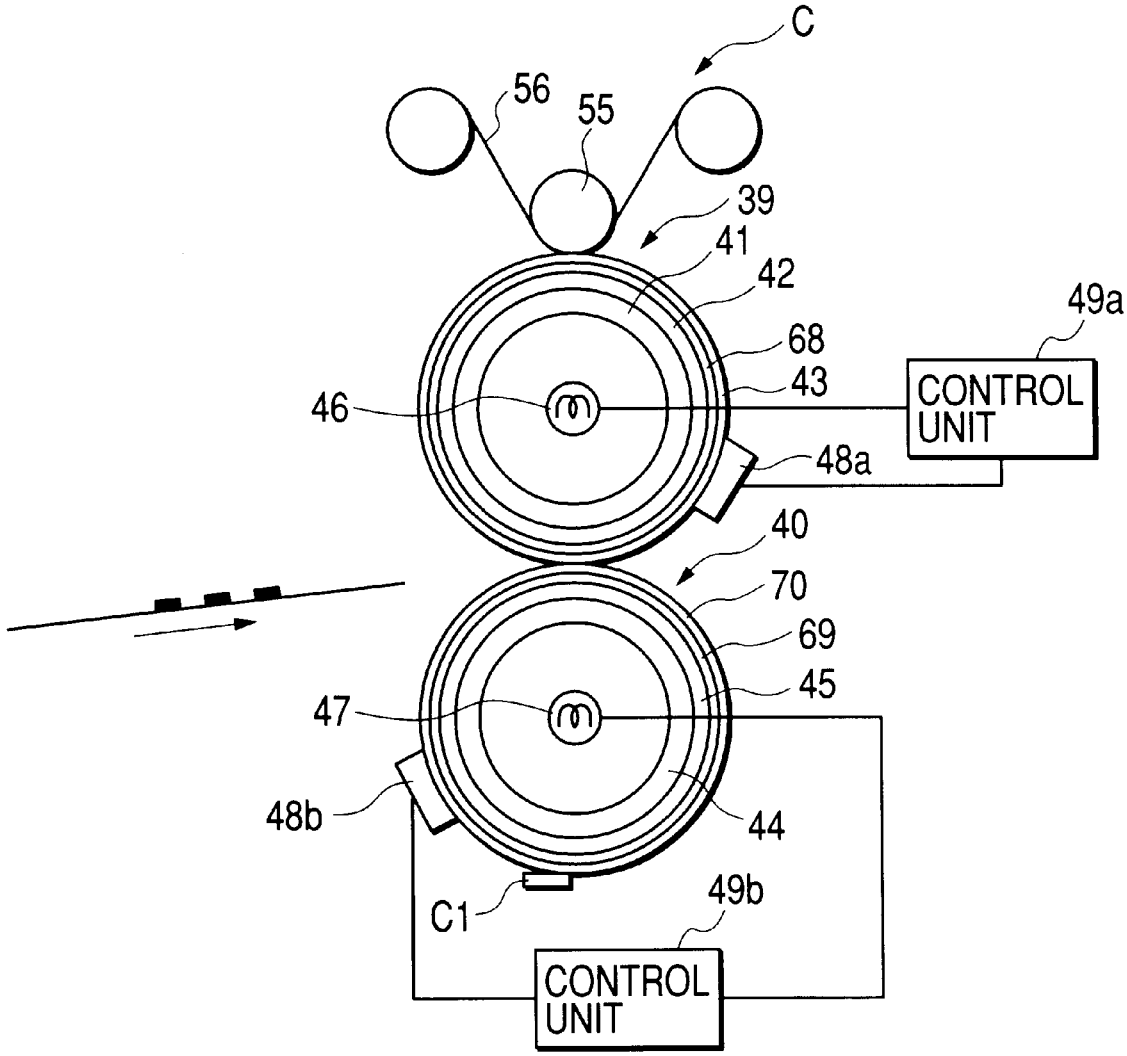
FIG. 2 is a schematic illustration showing an example of a heat-and-pressure fixing means.

FIG. 2 shows an example of a heat-and-pressure fixing means. A fixing means fixing roller 39 comprises, e.g., a mandrel 41 of 5 mm in wall thickness, made of aluminum, and provided thereon an RTV (room-temperature vulcanizing) silicone rubber (Asker-C hardness: 69) layer of 2 mm in thickness as an elastic layer 42 and, on the outer surface thereof, a tetrafluoroethylene/perfluoroalkyl vinyl ether copolymer (PFA) layer of 50 $\mu$m in thickness as a surface layer 43. Here, the fixing roller shown in FIG. 2 is so constructed as to provide an intermediate layer 68 between the elastic layer and the surface layer.

Meanwhile, a pressure means pressure roller 40 comprises, e.g., a mandrel 44 of 5 mm in wall thickness, made of aluminum, and provided thereon an RTV silicone rubber (rubber hardness Asker-C hardness: 82.5) layer of 2 mm in thickness as an elastic layer 45 and, on the outer surface thereof, a PFA layer of 50 $\mu$m in thickness as a surface layer 70. Here, the pressure roller shown in FIG. 2 is so constructed as to provide an intermediate layer 69 between the elastic layer and the surface layer.

In the fixing means shown in FIG. 2, both the fixing roller and the pressure roller have an outer diameter of 60 mm, but have hardness which is higher on the part of the pressure roller. Hence, in a delivery test using white paper, the direction of delivery comes on the side of the pressure roller below a perpendicular in respect to a line connecting the centers of the both rollers. Making this direction of delivery come on the side of the pressure roller is very important for preventing a fixing support (recording medium) from winding around the fixing roller when a copied image having a large image area percentage is fixed. As a means for making the direction of delivery come on the side of the pressure roller, it may include a method in which a difference in hardness is provided as described above, a method in which the diameter of the pressure roller is made smaller than that of the fixing roller, and a method in which the preset temperature on the side of the pressure roller is made higher than that of the fixing roller so that the water content on the back of fixing paper, i.e., the paper surface on the side of the pressure roller can more be evaporated in a larger amount to utilize the shrinkage of paper in a very small extent.

The fixing roller 39 is also provided with a heat-generating means halogen heater 46 and the pressure roller 40 is similarly provided with a halogen heater 47 inside the mandrel so that the heat can be applied on the both sides. The temperature of the fixing roller 39 and that of the pressure roller 40 are detected by thermistors 48*a* and 48*b* brought into contact with the fixing roller 39 and the pressure roller 40, respectively. In accordance with the temperature thus detected, the halogen heaters 46 and 47 are controlled by control units 49*a* and 49*b*, respectively, and the temperature of the fixing roller 39 and the temperature of the pressure roller 40 are so controlled as to be both kept at constant temperature (e.g., 160° C. plus-minus 10° C.). The fixing roller 39 and the pressure roller 40 are pressed against each other at a total pressure of 980 N (100 kgf) by means of a pressing mechanism (not shown).

In FIG. 2, letter symbol C denotes a fixing roller cleaning assembly making use of an oil-impregnated paper web, and C1 denotes a cleaning blade for removing any oil and stain having adhered to the pressure roller. As an oil with which the paper web is impregnated, the use of a silicone oil of 50 to 3,000 $mm^2/s$ (cSt) in viscosity (a silicone oil such as dimethylsilicone oil or diphenylsilicone oil) makes it easy to feed the oil in a small coating weight and constantly, and also makes fixed images have a high grade (in particular, uniform gloss and oil marks). Also, where any oil is not coated, the cleaning assembly C may be removed, or a paper or cloth web not impregnated with any oil may be used, or a cleaning blade, a cleaning pad or a cleaning roller may be used. In the present invention, it is preferable not to use any release agent oil. In such a case, good images free of any oil line marks can be obtained.

The cleaning assembly C has a nonwoven fabric web 56 comprised of NOMEX (trade name; available from Du Pont), which is pressed against the fixing roller 39 by a pressing roller 55 to perform cleaning. The web 56 is appropriately wound up by a wind-up unit (not shown) so that any toner and so forth do not deposit at the part of its contact with the fixing roller 39.

Where the coating weight of the oil is more than $1\times10^{-7}$ $g/cm^2$, the recording medium may greatly glare to tend to obstruct the legibility of letter or character images.

Through the image formation process described above, the color toner images having at least the toner used in the present invention are fixed to recording sheets, and thereby color images formed on the recording sheets are obtained.

Physical properties of the toner used in the present invention are measured in the manner described below.

(1) Measurement of Viscoelasticity of Toner:

Toner is pressure-molded into a disk-like sample having a diameter of 25 mm and a thickness of from about 2 to 3 mm. Next, the sample is set between parallel plates, and then heated gradually within the temperature range of from 50 to 200° C. to make measurement of temperature dispersion. Heating rate is set at 2° C./min, angular frequency (ω) is fixed at 6.28 rad/sec., and measurement of distortion rate is set automatic. Temperature is plotted as abscissa and storage elastic modulus (G') as ordinate, and values at every temperature are read. In the measurement, RDA-II (trade name; manufactured by Rheometrics Co.) is used.

(2) Measurement of Endothermic Peak by Differential Thermal Analysis:

Measured according to ASTM D3418-82, using a differential thermal analyzer (DSC measuring device) DSC-7 (manufactured by Perkin Elmer Co.).

A sample for measurement is precisely weighed in an amount of from 2 to 10 mg, preferably 5 mg. This sample is put in a pan made of aluminum and an empty aluminum pan is set as reference. Measurement is made in a normal-temperature normal-humidity environment at a heating rate of 10° C./min. within the measuring temperature range of from 30 to 200° C. In the course of this heating and cooling, main-peak endothermic and exothermic peaks of the DSC curve in the temperature range of from 30 to 200° C. are obtained.

(3) Measurement of Molecular-Weight Distribution by GPC:

Molecular weights of constituents in a chromatogram obtained by gel permeation chromatography (GPC) are measured under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a THF sample solution of resin which has been regulated to have a sample concentration of form 0.05 to 0.6% by weight is injected thereinto to make measurement. In measuring the molecular weight of the sample, the molecular weight distribution ascribed to the sample is calculated from the relationship between the logarithmic value and count number (retention time) of a calibration curve prepared using several kinds of monodisperse polystyrene standard samples. As the standard polystyrene samples used for the preparation of the calibration curve, it is suitable to use, e.g., samples with molecular weights of 600, 2,100, 4,000, 17,500, 51,000, 110,000, 390,000, 860,000, 2,000,000 and 4,480,000, which are available from Toso Co., Ltd. or Pressure Chemical Co., and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of Shodex GPC KF-801, KF-802, KF-803, KF-804, KF-805, KF-806 and KF-807, available from Showa Denko K.K., and μ-Styragel 500, 1,000, 10,000 and 100,000, available from Waters Co.

(4) Measurement of Particle Size Distribution of Toner:

In the present invention, the average particle diameter and particle size distribution of the toner are measured with Coulter Counter Model TA-II (manufactured by Coulter Electronics, Inc.). Coulter Multisizer (manufactured by Coulter Electronics, Inc.) may also be used. As an electrolytic solution, an aqueous 1% NaCl solution is prepared using first-grade sodium chloride. For example, ISOTON R-II (trade name; manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles of 2.00 μm or larger diameter by means of the above measuring instrument, using an aperture of 100 μm as its aperture. Then the weight-based, weight average particle diameter (D4: the middle value of each channel is used as the representative value for each channel) according to the present invention, determined from the volume distribution of toner particles, are determined.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

Figure 3:
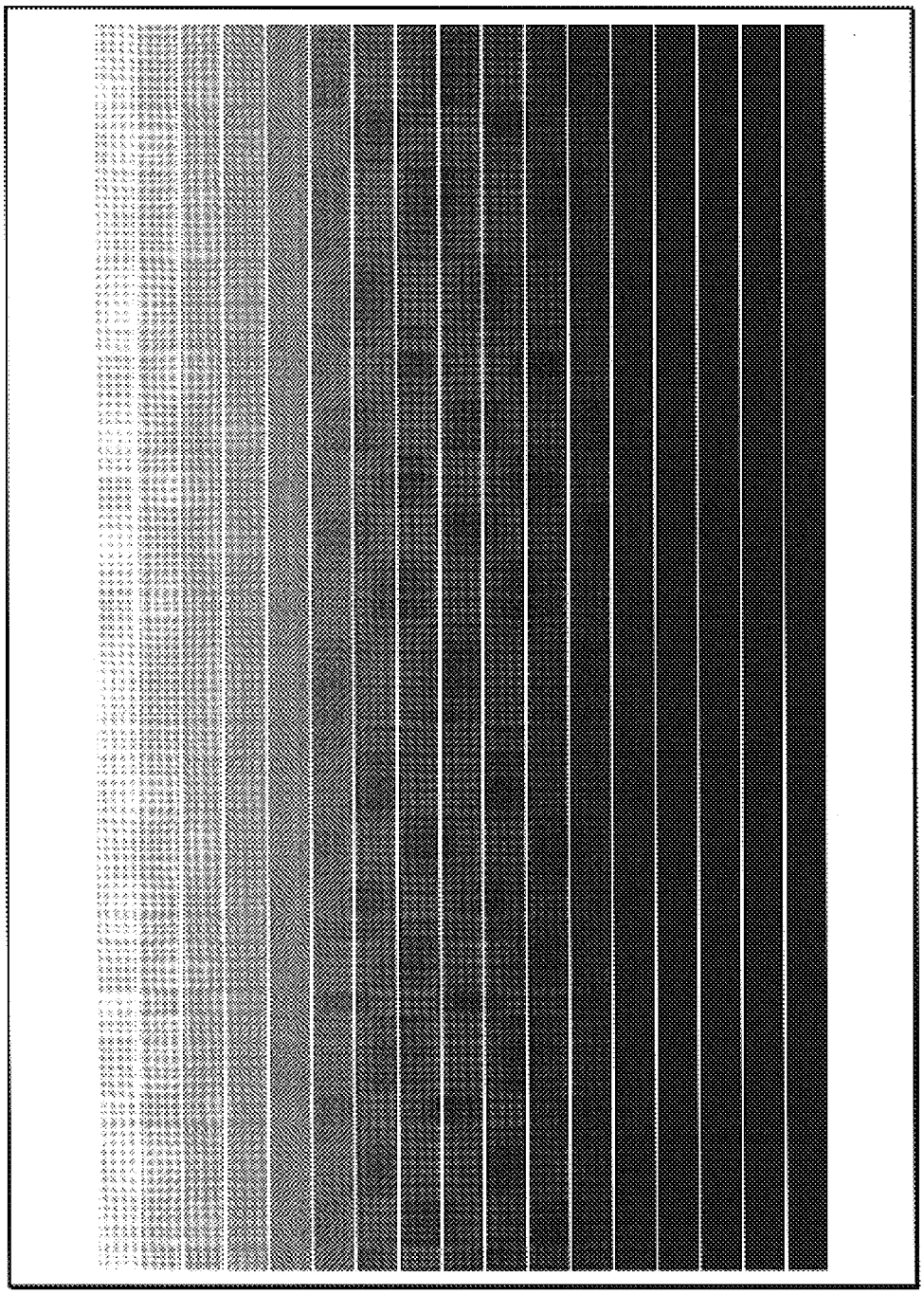
FIG. 3 is an illustration of a sample image used in the measurement of gloss.

(5) Measurement of Image Glossiness by Glossmeter:

In the present invention, the gloss value is measured with a glossmeter (trade name: GLOSSCHECKER IG-310; manufactured by Horiba K.K.) by measuring the amount of light reflected in the direction of 60 degrees. As a sample image, used is one in which, setting the toner laid-on quantity per unit area in 17 gradations at substantially equal intervals in the range of from 0.5 to 1.3 mg/cm$^2$, solid images (1 cm×29 cm each) formed in the respective toner laid-on quantities and arranged in the lateral direction of an A4 paper have been printed (see FIG. 3). Then, the gloss value of the solid images in the respective toner laid-on quantity is measured at five spots (both ends, the middle, and spots intermediate between each end and the middle) for each solid image, and its average value is regarded as image gloss value for each one.

(6) Measurement of Image Density:

In the present invention, as a method of measuring the image density, it is measured with Spectrodensitometer 504, manufactured by X-Rite Co. A measuring image is measured arbitrarily five times, and its average value is regarded as image density.

EXAMPLES

The present invention is described below by giving specific working examples. The present invention is by no means limited to these examples.

Hybrid Resin Production Example 1

As a vinyl monomer composition containing monomers and a polymerization initiator for obtaining the vinyl copolymer, 1.9 mols of styrene, 0.21 mol of 2-ethylhexyl acrylate, 0.15 mol of fumaric acid, 0.03 mol of a dimer of α-methylstyrene and 0.05 mol of dicumyl peroxide were put into a dropping funnel. Also, 7.0 mols of polyoxypropylene (2.2)-2,2-bis(4-hydroxyphenyl)propane, 3.0 mols of polyoxyethylene(2.2)-2,2-bis(4-hydroxyphenyl)propane, 3.0 mols of succinic acid, 2.0 mols of trimellitic anhydride, 5.0 mols of fumaric acid and 0.2 g of dibutyltin oxide were put into a 4-liter four-necked flask made of glass, and a thermometer, a stirring rod, a condenser and a nitrogen feed tube were attached thereto. This was placed in a mantle heater. Next, the inside of the flask was displaced with nitrogen gas, followed by gradual heating with stirring. With stirring at a temperature of 145° C., the monomers, the vinyl monomer composition was dropwise added thereto from the above dropping funnel over a period of 4 hours. Subsequently, the mixture formed was heated to 200° C. to carry out reaction for 4 hours. Thus, a hybrid resin composition (1) was obtained which contained a hybrid resin having the vinyl polymer unit and the polyester resin unit, in addition to a vinyl polymer and a polyester resin. Its molecular weight was measured by GPC to find that the weight-average molecular weight (Mw) was 25,700, the number-average molecular weight (Mn) was 3,200 and the peak molecular weight (Mp) was 6,400. The results of the measurement of molecular weight are shown in Table 2.

Hybrid Resin Production Example 2

The reaction was carried out in the same manner as in Hybrid Resin Production Example 1 except that 3.8 mols of styrene, 0.07 mol of a dimer of a-methylstyrene and 0.1 mol of dicumyl peroxide were used as the materials for vinyl polymer, to obtain a hybrid resin composition (2). Its molecular weight was measured by GPC to obtain the results shown in Table 2.

Hybrid Resin Production Example 3

The reaction was carried out in the same manner as in Hybrid Resin Production Example 1 except that in place of 5.0 mols of the fumaric acid 4.0 mols of maleic acid and 3.5 mols of itaconic acid were used and in place of 0.05 mol of the dicumyl peroxide 0.1 mol of isobutyl peroxide was used, to obtain a hybrid resin composition (3). Its molecular weight was measured by GPC to obtain the results shown in Table 2.

Hybrid Resin Production Example 4

The reaction was carried out in the same manner as in Hybrid Resin Production Example 1 except that in place of 3.0 mols of the succinic acid and 2.0 mols of the trimellitic anhydride 5.2 mols of trimellitic anhydride was used, to obtain a hybrid resin composition (4). Its molecular weight was measured by GPC to obtain the results shown in Table 2.

Polyester Resin Production Example 1

3.6 mols of polyoxypropylene(2.2)-2,2-bis(4-hydroxyphenyl)propane, 1.6 mols of polyoxyethylene(2.2)-2,2-bis(4-hydroxyphenyl)propane, 1.7 mols of terephthalic acid, 1.1 mols of trimellitic anhydride, 2.4 mols of fumaric acid and 0.1 g of dibutyltin oxide were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 215° C. for 5 hours to obtain a polyester resin (1). Its molecular weight was measured by GPC to obtain the results shown in Table 2.

Polyester Resin Production Example 2

With monomer constitution of 1.6 mols of polyoxypropylene(2.2)-2,2-bis(4-hydroxyphenyl)propane, 3.3 mols of polyoxyethylene(2.2)-2,2-bis(4-hydroxyphenyl) propane, 1.6 mols of terephthalic acid, 0.3 mol of trimellitic anhydride and 3.2 mols of fumaric acid, reaction was carried out like that in the above, to obtain a polyester resin (2). Its molecular weight was measured by GPC to obtain the results shown in Table 2.

Vinyl Polymer Production Example 1

1,000 ml of toluene and, as materials for vinyl copolymer, 2.4 mols of styrene, 0.26 mol of n-butyl acrylate, 0.09 mol of monobutyl maleate and 0.11 mol of di-t-butyl peroxide were put into a 3-liter four-necked flask having a thermometer, a stirring rod made of stainless steel, a falling-film condenser and a nitrogen feed tube. In a mantle heater, in an atmosphere of nitrogen, reaction was carried out at a temperature of 120° C. making toluene reflux with stirring to obtain a vinyl polymer (1). Its molecular weight was measured by GPC to obtain the results shown in Table 2.

TABLE 2

| Compositions | Results of molecular weight measurement (GPC) Mw ($\times 10^3$) | Mn ($\times 10^3$) | Mp ($\times 10^3$) | Mw/Mn |
|---|---|---|---|---|
| Polyester resin: | | | | |
| (1) | 25.7 | 3.2 | 6.4 | 8.03 |
| (2) | 4.3 | 2.2 | 3.1 | 1.95 |
| Hybrid resin composition: | | | | |
| (1) | 83.0 | 3.1 | 15.4 | 26.77 |
| (2) | 72.1 | 3.2 | 15.1 | 22.53 |
| (3) | 108.1 | 4.2 | 30.3 | 25.74 |
| (4) | 294.9 | 4.5 | 89.4 | 65.53 |
| Vinyl polymer: | | | | |
| (1) | 19.0 | 2.7 | 9.1 | 7.04 |

Waxes used in the following Examples and Comparative Examples are shown in Table 3 below.

TABLE 3

| Wax | Melting point | Type of wax |
|---|---|---|
| Wax (A) | 74.3° C. | purified normal paraffin |
| Wax (B) | 72.7° C. | ester wax |
| Wax (C) | 51.0° C. | paraffin |
| Wax (D) | 95.7° C. | polyethylene |
| Wax (E) | 108.9° C. | alcohol-modified PE |

Examples 1 to 4

Cyan toner 1 was prepared in the following way.

| | (by weight) |
|---|---|
| Hybrid resin composition (1) | 100 parts |
| Wax (A) | 9 parts |
| C.I. Pigment Blue 15:3 | 5 parts |
| Di-tert-butylsalicylic acid aluminum complex | 6 parts |

The above materials were sufficiently premixed by means of a Henschel mixer, and thereafter the mixture obtained was melt-kneaded using a twin-screw kneader. The kneaded product obtained was cooled and thereafter crushed by means of a hammer mill to a size of about 1 to 2 mm in diameter. The crushed product was then finely pulverized by means of a fine-grinding mill of an air jet system. The finely pulverized product thus obtained was further classified using a multi-division classifier to obtain cyan resin particles with a weight-average particle diameter of 7.6 $\mu$m.

To 100 parts by weight of the cyan resin particles, 1.1 parts by weight of hydrophobic aluminum oxide particles (BET specific surface area: 170 $m^2/g$) having been treated with 25 parts by weight of $i\text{-}C_4H_9Si(OCH_3)_3$ in an amount of 25 parts by weight based on 100 parts by weight of the parent particles were added to obtain a cyan toner 1. This cyan toner 1 and magnetic ferrite carrier particles (average particle diameter: 50 $\mu$m) having been surface-coated with silicone resin were so blended as to be in a toner concentration of 6% by weight to prepare a two-component cyan developer 1. Formulation and physical properties of the toner are shown in Tables 4(A) and 4(B).

Using this cyan developer 1 and using a remodeled machine of a color copying machine CLC-800 (trade name, manufactured by CANON INC.) from which a fixing unit had been detached, the sample image as stated above (see FIG. 3) was reproduced in a monochromatic mode in an environment of normal temperature and normal humidity (23° C., 60%RH) Toner images formed were fixed by means of a fixing assembly obtained by detaching the roller cleaning assembly C from the fixing assembly shown in FIG. 2. On the fixed images obtained, their gloss values were measured. In the fixing assembly, a fixing roller was used which comprised a mandrel of 5 mm in wall thickness, made of aluminum, and provided thereon an RTV silicone rubber layer (Asker-C hardness: 69) of 2 mm in thickness as an elastic layer and, on the outer surface thereof, a tetrafluoroethylene/perfluoroalkyl vinyl ether copolymer (PFA) layer of 50 $\mu$m in thickness as a surface layer (having no intermediate layer).

Here, used as recording paper (recording mediums) were, in the order of one having higher gloss, cast-coated paper (CANON CLC Gloss Cardboard NS701, trade name; basis weight: 150 $g/m^2$; gloss value: 75), coated paper (CANON GLOSSY Brochure Paper, trade name; basis weight: 148 $g/m^2$; gloss value: 50), OFFSET M-DREAL (trade name), available from Silver Blade Co. (basis weight: 200 $g/m^2$; gloss value: 7), and woodfree paper (CANON CLC Paper, trade name; basis weight: 81.4 $g/m^2$; gloss value: 2).

Using these recording mediums and at the process speed and fixing temperature as shown in Tables 5(A) and 5(B), fixed images were formed in the cases (i) when high-gloss recording mediums were used and (ii) when low-gloss recording mediums were used (Examples 1 to 4).

To also measure the image density ($D_{0.5}$), images having a toner laid-on quantity of 0.5 $mg/cm^2$ per unit area were formed, and their image density was measured.

The images obtained in Examples 1 to 4 had, without depending on the toner laid-on quantity, substantially uniform image gloss, which was also close to the glossiness of the recording mediums. Also, the images were formed showing good fixing performance. The results are shown in Tables 5(A) and 5(B).

Example 5

A cyan toner 2 and a cyan developer 2 were obtained in the same manner as in Example 1 except that in place of the hybrid resin composition (1) the hybrid resin composition (2) was used. The results of the measurement of physical properties of the toner are shown in Tables 4(A) and 4(B).

The toner was also evaluated in the same manner as in Example 1. The images obtained in Example 5 had, without depending on the toner laid-on quantity, substantially uniform image gloss, which was also close to the glossiness of the recording mediums, and were formed showing good fixing performance. The results are shown in Tables 5(A) and 5(B).

Example 6

A cyan toner 3 and a cyan developer 3 were obtained in the same manner as in Example 1 except that in place of the hybrid resin composition (1) the hybrid resin composition (3) was used and the di-tert-butylsalicylic acid aluminum complex was used in an amount of 8 parts by weight. The results of the measurement of physical properties of the toner are shown in Tables 4(A) and 4(B).

The toner was also evaluated in the same manner as in Example 1. The images obtained in Example 6 had, without depending on the toner laid-on quantity, substantially uniform image gloss, which was also close to the glossiness of the recording mediums, and were formed showing good fixing performance. The results are shown in Tables 5(A) and 5(B).

Example 7

A cyan toner 4 and a cyan developer 4 were obtained in the same manner as in Example 1 except that the di-tert-butylsalicylic acid aluminum complex was used in an amount of 2 parts by weight. The results of the measurement of physical properties of the toner are shown in Tables 4(A) and 4(B).

The toner was also evaluated in the same manner as in Example 1. The images obtained in Example 7 had, without depending on the toner laid-on quantity, substantially uniform image gloss, which was also close to the glossiness of the recording mediums, and were formed showing good fixing performance. The results are shown in Tables 5(A) and 5(B).

Example 8

A cyan toner 5 and a cyan developer 5 were obtained in the same manner as in Example 1 except that in place of the hybrid resin composition (1) a mixture of 50 parts by weight of the polyester resin (1) and 50 parts by weight of the hybrid resin composition (1) was used and the di-tert-butylsalicylic acid aluminum complex was used in an amount of 8 parts by weight. The results of the measurement of physical properties of the toner are shown in Tables 4(A) and 4(B).

The toner was also evaluated in the same manner as in Example 1. The images obtained in Example 8 had, without depending on the toner laid-on quantity, substantially uniform image gloss, which was also close to the glossiness of the recording mediums, and were formed showing good fixing performance. The results are shown in Tables 5(A) and 5(B).

Example 9

A cyan toner 6 and a cyan developer 6 were obtained in the same manner as in Example 1 except that in place of the wax (A) the wax (B) was used. The results of the measurement of physical properties of the toner are shown in Tables 4(A) and 4(B).

The toner was also evaluated in the same manner as in Example 1. The images obtained in Example 9 had without depending on the toner laid-on quantity, substantially uniform image gloss, which was also close to the glossiness of the recording mediums. Also, the images were formed showing good fixing performance. The results are shown in Tables 5(A) and 5(B).

Example 10

A cyan toner 7 and a cyan developer 7 were obtained in the same manner as in Example 1 except that the di-tert-butylsalicylic acid aluminum complex was used in an amount of 3 parts by weight and in place of the wax (A) the wax (D) was used. The results of the measurement of physical properties of the toner are shown in Tables 4(A) and 4(B).

The toner was also evaluated in the same manner as in Example 1. Since in the cyan toner 7 the wax had a high melting point, the wax became difficult to come to toner particle surfaces at the time of fixing to make low-temperature fixing performance a little poor, but relatively good results were obtained. The images obtained in Example 10 had, without depending on the toner laid-on quantity, substantially uniform image gloss, which was also close to the glossiness of the recording mediums. The results are shown in Tables 5(A) and 5(B).

Example 11

A cyan toner 8 and a cyan developer 8 were obtained in the same manner as in Example 1 except that the di-tert-butylsalicylic acid aluminum complex was used in an amount of 3 parts-by weight and in place of the wax (A) the wax (E) was used. The results of the measurement of physical properties of the toner are shown in Tables 4(A) and 4(B).

The toner was also evaluated in the same manner as in Example 1. Since in the cyan toner 8 the wax had a high melting point, the wax became difficult to come to toner particle surfaces at the time of fixing to lower low-temperature fixing performance, but relatively good results were obtained as a whole. The images obtained in Example 11 had, without depending on the toner laid-on quantity, substantially uniform image gloss, which was also close to the glossiness of the recording mediums. The results are shown in Tables 5(A) and 5(B).

Example 12

A magenta toner 1 (as toner 9) and a magenta developer 1 were obtained in the same manner as in Example 1 except that, in place of the C.I. Pigment Blue 15:3, C.I. Pigment Red 202 was used in an amount of 6 parts by weight. The results of the measurement of physical properties of the toner are shown in Tables 4(A) and 4(B).

The toner was also evaluated in the same manner as in Example 1. The images obtained in Example 12 had, without depending on the toner laid-on quantity, substantially uniform image gloss, and highly minute images having a glossiness close to that of the recording medium were obtainable. Also, the images were formed showing good fixing performance. The results are shown in Tables 5(A) and 5(B).

Example 13

A yellow toner 1 (as toner 10) and a yellow developer 1 were obtained in the same manner as in Example 1 except that, in place of the C.I. Pigment Blue 15:3, C.I. Pigment Yellow 17 was used in an amount of 4 parts by weight and in place of the hybrid resin composition (1) the polyester resin (1) was used. The results of the measurement of physical properties of the toner are shown in Tables 4(A) and 4(B).

The toner was also evaluated in the same manner as in Example 1. The images obtained in Example 13 had, without depending on the toner laid-on quantity, substantially uniform image gloss, and highly minute images having a glossiness close to that of the recording medium were obtainable. Since the polyester resin was used alone, the fixable temperature region came a little narrow compared with that in Example 1, but the fixing temperature width was on a level not problematic in practical use. The results are shown in Tables 5(A) and 5(B).

Example 14

A black toner 1 (as toner 11) and a black developer 1 were obtained in the same manner as in Example 1 except that, in place of the C.I. Pigment Blue 15:3, carbon black was used in an amount of 3 parts by weight. The results of the measurement of physical properties of the toner are shown in Tables 4(A) and 4(B).

The toner was also evaluated in the same manner as in Example 1. The images obtained in Example 14 had, without depending on the toner laid-on quantity, substantially uniform image gloss, and highly minute images having a glossiness close to that of the recording medium were obtainable. The results are shown in Tables 5(A) and 5(B).

Example 15

A cyan toner 12 and a cyan developer 12 were obtained in the same manner as in Example 1 except that classification conditions were controlled to obtain cyan toner particles with a weight-average particle diameter of 4.1 $\mu$m and the hydrophobic aluminum oxide particles (BET specific surface area: 170 $m^2/g$) were used in an amount of 1.8 parts by weight based on 100 parts by weight of the cyan toner particles. The results of the measurement of physical properties of the toner are shown in Tables 4(A) and 4(B).

The toner was also evaluated in the same manner as in Example 1. Though showing a little inferior transfer performance, the images obtained in Example 15 had, without depending on the toner laid-on quantity, substantially uniform image gloss, and highly minute images having a glossiness close to that of the recording medium were obtainable. The results are shown in Tables 5(A) and 5(B).

Example 16

A cyan toner 13 and a cyan developer 13 were obtained in the same manner as in Example 1 except that classification conditions were controlled to obtain cyan toner particles with a weight-average particle diameter of 9.9 $\mu$m and the hydrophobic aluminum oxide particles (BET specific surface area: 170 $m^2/g$) were used in an amount of 0.8 part by weight based on 100 parts by weight of the cyan toner particles. The results of the measurement of physical properties of the toner are shown in Tables 4(A) and 4(B).

The toner was also evaluated in the same manner as in Example 1. Though showing a little inferior fine-line reproducibility because of the toner having a large particle diameter, the images obtained in Example 16 had, without depending on the toner laid-on quantity, substantially uniform image gloss, and highly minute images having a glossiness close to that of the recording medium were obtainable. The results are shown in Tables 5(A) and 5(B).

Example 17

A cyan toner 14 and a cyan developer 14 were obtained in the same manner as in Example 1 except that, in place of the di-tert-butylsalicylic acid aluminum complex, a di-tert-butylsalicylic acid zinc complex was used in an amount of 6 parts by weight. The results of the measurement of physical properties of the toner are shown in Tables 4(A) and 4(B).

The toner was also evaluated in the same manner as in Example 1. Though showing a little low image density and transfer efficiency, the images obtained in Example 17 had, without depending on the toner laid-on quantity, substantially uniform image gloss, and highly minute images having a glossiness close to that of the recording medium were obtainable. The results are shown in Tables 5(A) and 5(B).

Comparative Example 1

A cyan toner 15 and a cyan developer 15 were obtained in the same manner as in Example 1 except that in place of the hybrid resin composition (1) the hybrid resin composition (4) was used and the di-tert-butylsalicylic acid aluminum complex was used in an amount of 7.5 parts by weight. The results of the measurement of physical properties of the toner are shown in Tables 4(A) and 4(B).

Using the cyan developer 15, evaluation was made in the same manner as in Example 1.

The cyan toner 15 was, because of a large peak molecular weight of the resin contained, a very hard toner and showed a poor glossiness, which also differed greatly from the glossiness of the recording medium and was in a non-uniform image gloss. Also, the wax was difficult to come to toner particle surfaces at the time of fixing, and hence the low-temperature fixing performance was poor. The results are shown in Tables 5(A) and 5(B).

Comparative Example 2

A cyan toner 16 and a cyan developer 16 were obtained in the same manner as in Example 1 except that in place of the hybrid resin composition (1) the polyester resin (2) was used and the di-tert-butylsalicylic acid aluminum complex was used in an amount of 4 parts by weight. The results of the measurement of physical properties of the toner are shown in Tables 4(A) and 4(B).

Using the cyan developer 16, evaluation was also made in the same manner as in Example 1.

The cyan toner 16 was, because of a small peak molecular weight of the resin contained, a very soft toner and images formed had a very high glossiness, which also differed so greatly from the glossiness of the recording medium that images formed gave a sense of incongruity because of non-uniform image. The results are shown in Tables 5(A) and 5(B).

Comparative Example 3

A cyan toner 17 and a cyan developer 17 were obtained in the same manner as in Example 1 except that in place of the hybrid resin composition (1) the polyester resin (1) was used and the di-tert-butylsalicylic acid aluminum complex was used in an amount of 12 parts by weight. The results of the measurement of physical properties of the toner are shown in Tables 4(A) and 4(B).

Using the cyan developer 17, evaluation was also made in the same manner as in Example 1.

The cyan toner 17 was a very hard toner and hence showed a poor glossiness. Also, the wax was difficult to come to toner particle surfaces at the time of fixing, and hence the fixing performance was poor. At a high process speed, it was unable to perform the fixing. The results are shown in Tables 5(A) and 5(B).

Comparative Example 4

A cyan toner 18 and a cyan developer 18 were obtained in the same manner as in Example 1 except that in place of the purified normal paraffin wax (A) the low-melting point paraffin wax (C) was used. The results of the measurement of physical properties of the toner are shown in Tables 4(A) and 4(B).

Using the cyan developer 18, evaluation was also made in the same manner as in Example 1.

As the result, the cyan toner 18, which contained the low-melting point wax, showed an inferior developing performance, and the images obtained had non-uniform image gloss, giving a sense of incongruity. The results are shown in Tables 5(A) and 5(B).

Comparative Example 5

A cyan toner 19 and a cyan developer 19 were obtained in the same manner as in Example 1 except that the di-tert-butylsalicylic acid aluminum complex was not used. The results of the measurement of physical properties of the toner are shown in Tables 4(A) and 4(B).

Using the cyan developer 19, evaluation was also made in the same manner as in Example 1.

The cyan toner 19, which did not contain the di-tert-butylsalicylic acid aluminum complex, was unable to have any satisfactory properties in relation to the charging performance, fixing performance and viscoelasticity of the toner. As the result, the images obtained in Comparative Example 5 had non-uniform image gloss, giving a sense of incongruity. The results are shown in Tables 5(A) and 5(B).

Comparative Example 6

A cyan toner 20 and a cyan developer 20 were obtained in the same manner as in Example 1 except that in place of the hybrid resin composition (1) the vinyl polymer (1) was used and the di-tert-butylsalicylic acid aluminum complex was used in an amount of 7.5 parts by weight. The results of the measurement of physical properties of the toner are shown in Tables 4(A) and 4(B).

Using the cyan developer 20, evaluation was also made in the same manner as in Example 1.

The cyan toner 20 showed a poor glossiness and non-uniform image gloss, giving a sense of incongruity. The results are shown in Tables 5(A) and 5(B).

TABLE 4(A)

| | Toner No. | Pigment | Resin | Organo-metallic compound (pbw) | Wax | 80° C. Storage elastic modulus G' | 120–180° C. Storage elastic modulus G' Minimum value | 120–180° C. Storage elastic modulus G' Maximum value | Storage elastic modulus ratio |
|---|---|---|---|---|---|---|---|---|---|
| Example: | | | | | | | | | |
| 1 | 1 | C | Hybrid (1) | Al: 6 | (A) | $5.2 \times 10^6$ | $3.4 \times 10^6$ | $1.3 \times 10^6$ | 3.8 |
| 2 | 1 | C | Hybrid (1) | Al: 6 | (A) | $5.2 \times 10^6$ | $3.4 \times 10^6$ | $1.3 \times 10^6$ | 3.8 |
| 3 | 1 | C | Hybrid (1) | Al: 6 | (A) | $5.2 \times 10^6$ | $3.4 \times 10^6$ | $1.3 \times 10^6$ | 3.8 |
| 4 | 1 | C | Hybrid (1) | Al: 6 | (A) | $5.2 \times 10^6$ | $3.4 \times 10^6$ | $1.3 \times 10^6$ | 3.8 |
| 5 | 2 | C | Hybrid (2) | Al: 6 | (A) | $5.8 \times 10^6$ | $2.1 \times 10^5$ | $4.2 \times 10^5$ | 2.0 |
| 6 | 3 | C | Hybrid (3) | Al: 8 | (A) | $1.2 \times 10^6$ | $3.4 \times 10^5$ | $8.8 \times 10^5$ | 2.6 |
| 7 | 4 | C | Hybrid (1) | Al: 2 | (A) | $2.2 \times 10^6$ | $6.5 \times 10^5$ | $9.7 \times 10^3$ | 1.5 |
| 8 | 5 | C | Polyester (1)/ Hybrid (1) | Al: 8 | (A) | $4.4 \times 10^6$ | $4.5 \times 10^5$ | $2.1 \times 10^5$ | 4.7 |
| 9 | 6 | C | Hybrid (1) | Al: 6 | (B) | $7.3 \times 10^6$ | $1.1 \times 10^4$ | $4.2 \times 10^4$ | 3.8 |
| 10 | 7 | C | Hybrid (1) | Al: 3 | (D) | $6.5 \times 10^7$ | $3.1 \times 10^5$ | $7.3 \times 10^5$ | 2.4 |
| 11 | 8 | C | Hybrid (1) | Al: 3 | (E) | $8.2 \times 10^7$ | $6.8 \times 10^5$ | $8.8 \times 10^5$ | 1.3 |
| 12 | 9 | M | Hybrid (1) | Al: 6 | (A) | $4.5 \times 10^6$ | $3.1 \times 10^4$ | $1.4 \times 10^5$ | 4.5 |
| 13 | 10 | Y | Polyester (1) | Al: 6 | (A) | $5.6 \times 10^6$ | $3.1 \times 10^4$ | $1.5 \times 10^5$ | 4.8 |
| 14 | 11 | Bk | Hybrid (1) | Al: 6 | (A) | $5.0 \times 10^6$ | $3.6 \times 10^4$ | $1.4 \times 10^5$ | 3.9 |
| 15 | 12 | C | Hybrid (1) | Al: 6 | (A) | $5.2 \times 10^6$ | $3.4 \times 10^4$ | $1.3 \times 10^5$ | 3.8 |
| 16 | 13 | C | Hybrid (1) | Al: 6 | (A) | $5.2 \times 10^6$ | $3.4 \times 10^4$ | $1.3 \times 10^5$ | 3.8 |
| 17 | 14 | C | Hybrid (1) | Zn: 6 | (A) | $4.5 \times 10^6$ | $1.3 \times 10^4$ | $2.1 \times 10^5$ | 16.2 |
| Comparative Example: | | | | | | | | | |
| 1 | 15 | C | Hybrid (4) | Al: 7.5 | (A) | $2.7 \times 10^{10}$ | $2.2 \times 10^7$ | $5.8 \times 10^8$ | 26.4 |
| 2 | 16 | C | Polyester (2) | Al: 4 | (A) | $2.3 \times 10^6$ | $1.2 \times 10^3$ | $8.6 \times 10^3$ | 7.2 |
| 3 | 17 | C | Polyester (1) | Al: 12 | (A) | $1.2 \times 10^{10}$ | $1.8 \times 10^7$ | $3.1 \times 10^8$ | 17.2 |
| 4 | 18 | C | Hybrid (1) | Al: 6 | (C) | $4.4 \times 10^6$ | $1.8 \times 10^4$ | $1.3 \times 10^5$ | 7.2 |
| 5 | 19 | C | Hybrid (1) | 0 | (A) | $1.1 \times 10^6$ | $1.8 \times 10^2$ | $2.8 \times 10^3$ | 15.6 |
| 6 | 20 | C | vinyl (1) | Al: 7.5 | (A) | $4.6 \times 10^{10}$ | $1.4 \times 10^4$ | $2.1 \times 10^5$ | 15.0 |

TABLE 4(B)

| | 30–120° C. DSC maximum peak temperature: Endothermic curve endothermic peak | 30–120° C. DSC maximum peak temperature: Exothermic curve exothermic peak | Molecular-weight measurement results (GPC): Mp | Mw | Mn | Mw/Mn | Weight average particle diameter (μm) |
|---|---|---|---|---|---|---|---|
| Example: | | | | | | | |
| 1 | 67.9 | 63.9 | 8,800 | 17,500 | 3,500 | 5.0 | 7.6 |
| 2 | 67.9 | 63.9 | 8,800 | 17,500 | 3,500 | 5.0 | 7.6 |
| 3 | 67.9 | 63.9 | 8,800 | 17,500 | 3,500 | 5.0 | 7.6 |
| 4 | 67.9 | 63.9 | 8,800 | 17,500 | 3,500 | 5.0 | 7.6 |
| 5 | 67.4 | 62.5 | 8,300 | 12,635 | 3,700 | 3.4 | 8.0 |

TABLE 4(B)-continued

| | 30–120° C. DSC maximum peak temperature | | Molecular-weight measurement results (GPC) | | | | Weight average particle diameter |
|---|---|---|---|---|---|---|---|
| | Endothermic curve endothermic peak | Exothermic curve exothermic peak | Mp | Mw | Mn | Mw/Mn | (μm) |
| 6 | 73.2 | 68.8 | 9,700 | 14,950 | 4,740 | 3.2 | 8.1 |
| 7 | 63.1 | 57.4 | 6,500 | 12,600 | 2,650 | 4.8 | 8.0 |
| 8 | 66.8 | 62.2 | 8,200 | 13,600 | 3,650 | 3.7 | 7.9 |
| 9 | 67.7 | 64.4 | 8,400 | 13,500 | 3,730 | 3.6 | 8.3 |
| 10 | 98.1 | 85.2 | 14,600 | 19,400 | 6,500 | 3.0 | 7.8 |
| 11 | 104.1 | 89.7 | 12,800 | 18,600 | 6,140 | 3.0 | 8.1 |
| 12 | 66.9 | 63.6 | 8,500 | 13,750 | 3,700 | 3.7 | 7.7 |
| 13 | 68.2 | 61.8 | 8,700 | 13,600 | 3,800 | 3.6 | 7.5 |
| 14 | 67.5 | 61.9 | 8,300 | 13,400 | 3,800 | 3.5 | 8.3 |
| 15 | 68.1 | 63.9 | 8,800 | 17,500 | 3,500 | 5.0 | 4.1 |
| 16 | 68.1 | 63.9 | 8,800 | 17,500 | 3,500 | 5.0 | 9.9 |
| 17 | 69.2 | 64.1 | 8,000 | 13,500 | 3,560 | 3.8 | 8.8 |
| Comparative Example: | | | | | | | |
| 1 | 69.5 | 63.1 | 19,000 | 16,700 | 5,970 | 2.8 | 7.7 |
| 2 | 66.7 | 61.4 | 4,500 | 16,800 | 2,700 | 6.2 | 8.0 |
| 3 | 68.8 | 60.9 | 17,000 | 15,500 | 4,540 | 3.4 | 7.7 |
| 4 | 59.9 | 54.8 | 7,900 | 13,800 | 3,100 | 4.5 | 7.9 |
| 5 | 55.4 | 50.8 | 6,500 | 7,100 | 1,550 | 4.6 | 7.8 |
| 6 | 65.4 | 62.0 | 16,400 | 15,100 | 4,660 | 3.2 | 7.9 |

TABLE 5(A)

| | Toner No. | Pigment | Resin | Organometallic compound (pbw) | Wax |
|---|---|---|---|---|---|
| Example: | | | | | |
| 1 | 1 | C | Hybrid (1) | Al: 6 | A |
| 2 | 1 | C | Hybrid (1) | Al: 6 | A |
| 3 | 1 | C | Hybrid (1) | Al: 6 | A |
| 4 | 1 | C | Hybrid (1) | Al: 6 | A |
| 5 | 2 | C | Hybrid (2) | Al: 6 | A |
| 6 | 3 | C | Hybrid (3) | Al: 8 | A |
| 7 | 4 | C | Hybrid (1) | Al: 2 | A |
| 8 | 5 | C | Polyester (1)/ Hybrid (1) | Al: 8 | A |
| 9 | 6 | C | Hybrid (1) | Al: 6 | B |
| 10 | 7 | C | Hybrid (1) | Al: 3 | D |
| 11 | 8 | C | Hybrid (1) | Al: 3 | E |
| 12 | 9 | M | Hybrid (1) | Al: 6 | A |
| 13 | 10 | Y | Polyester (1) | Al: 6 | A |

TABLE 5(A)-continued

| | Toner No. | Pigment | Resin | Organometallic compound (pbw) | Wax |
|---|---|---|---|---|---|
| 14 | 11 | Bk | Hybrid (1) | Al: 6 | A |
| 15 | 12 | C | Hybrid (1) | Al: 6 | A |
| 16 | 13 | C | Hybrid (1) | Al: 6 | A |
| 17 | 14 | C | Hybrid (1) | Zn: 6 | A |
| Comparative Example: | | | | | |
| 1 | 15 | C | Hybrid (4) | Al: 7.5 | A |
| 2 | 16 | C | Polyester (2) | Al: 4 | A |
| 3 | 17 | C | Polyester (1) | Al: 12 | A |
| 4 | 18 | C | Hybrid (1) | Al: 6 | C |
| 5 | 19 | C | Hybrid (1) | 0 | A |
| 6 | 20 | C | Vinyl (1) | Al: 7.5 | A |

TABLE 5(B)

| | (i) | | | | | | (ii) | | | | | |
|---|---|---|---|---|---|---|---|---|---|---|---|---|
| | $G_0$ | PS1 (mm/sec) | Fixing temp. (° C.) | Image density ($D_{0.5}$) | $G_{max1}$ | $G_{min1}$ | $G_0$ | PS2 (mm/sec) | Fixing temp. (° C.) | Image density ($D_{0.5}$) | $G_{max2}$ | $G_{min2}$ |
| Example: | | | | | | | | | | | | |
| 1 | 50 | 60 | 170 | 1.54 | 60 | 43 | 2 | 250 | 160 | 1.29 | 9 | 0 |
| 2 | 50 | 30 | 155 | 1.63 | 74 | 46 | 2 | 150 | 150 | 1.31 | 12 | 1 |
| 3 | 50 | 120 | 190 | 1.31 | 57 | 39 | 2 | 350 | 180 | 1.35 | 5 | 0 |
| 4 | 75 | 60 | 190 | 1.64 | 88 | 72 | 7 | 250 | 160 | 1.22 | 13 | 4 |
| 5 | 50 | 60 | 170 | 1.52 | 52 | 32 | 2 | 250 | 160 | 1.28 | 7 | 0 |
| 6 | 50 | 60 | 170 | 1.39 | 48 | 28 | 2 | 250 | 160 | 1.33 | 6 | 1 |
| 7 | 50 | 60 | 170 | 1.59 | 76 | 47 | 2 | 250 | 160 | 1.31 | 14 | 3 |
| 8 | 50 | 60 | 170 | 1.55 | 59 | 40 | 2 | 250 | 160 | 1.30 | 8 | 2 |
| 9 | 50 | 60 | 170 | 1.56 | 63 | 45 | 2 | 250 | 160 | 1.29 | 10 | 1 |
| 10 | 50 | 60 | 170 | 1.56 | 61 | 38 | 2 | 250 | 160 | 1.34 | 10 | 1 |

TABLE 5(B)-continued

| | (i) | | | | | | (ii) | | | | | |
|---|---|---|---|---|---|---|---|---|---|---|---|---|
| | $G_0$ | PS1 (mm/sec) | Fixing temp. (° C.) | Image density ($D_{0.5}$) | $G_{max1}$ | $G_{min1}$ | $G_0$ | PS2 (mm/sec) | Fixing temp. (° C.) | Image density ($D_{0.5}$) | $G_{max2}$ | $G_{min2}$ |
| 11 | 50 | 60 | 170 | 1.54 | 58 | 35 | 2 | 250 | 160 | 1.29 | 8 | 0 |
| 12 | 50 | 60 | 170 | 1.57 | 62 | 44 | 2 | 250 | 160 | 1.31 | 10 | 1 |
| 13 | 50 | 60 | 170 | 1.59 | 61 | 39 | 2 | 250 | 160 | 1.30 | 8 | 2 |
| 14 | 50 | 60 | 170 | 1.60 | 65 | 43 | 2 | 250 | 160 | 1.33 | 12 | 4 |
| 15 | 50 | 60 | 170 | 1.60 | 61 | 40 | 2 | 250 | 160 | 1.32 | 8 | 1 |
| 16 | 50 | 60 | 170 | 1.53 | 58 | 38 | 2 | 250 | 160 | 1.29 | 7 | 0 |
| 17 | 50 | 60 | 170 | 1.55 | 72 | 48 | 2 | 250 | 160 | 1.21 | 14 | 5 |
| Comparative Example: | | | | | | | | | | | | |
| 1 | 50 | 60 | 170 | 1.19 | 42 | 23 | 2 | 250 | 160 | 1.08 | 4 | 0 |
| 2 | 50 | 60 | 170 | 1.71 | 86 | 62 | 2 | 250 | 160 | 1.31 | 24 | 8 |
| 3 | 50 | 60 | 170 | 1.19 | 49 | 31 | 2 | 250 | 160 | NG | -offset | NG- |
| 4 | 50 | 60 | 170 | 1.01 | 65 | 17 | 2 | 250 | 160 | 0.84 | 10 | 0 |
| 5 | 50 | 60 | 170 | 1.15 | 72 | 21 | 2 | 250 | 160 | 0.93 | 15 | 0 |
| 6 | 50 | 60 | 170 | 1.07 | 43 | 15 | 2 | 250 | 160 | 0.88 | 10 | 0 |

What is claimed is:

1. An image-forming method comprising:

a developing step of developing an electrostatic latent image held on an image-bearing member, by means of a toner to obtain a toner image;

a transfer step of transferring the toner image to a recording medium; and a fixing step of heating the toner image having been transferred onto the recording medium, to fix the former to the latter; and having at least:

a low-speed mode PS1 in which images are formed at a low speed; and a high-speed mode PS2 in which images are formed at a high speed;

so as to be able to form images at different speeds;

said recording medium having a gloss value (60-degree gloss) represented by $G_0$ and said toner being laid on said recording medium in a quantity ranging from 0.05 mg/cm$^2$ or more to 1.3 mg/cm$^2$ or less, under conditions of which;

(i) when a recording medium having a high gloss ($G_0$>40) is used, an image is formed at a low-speed mode PS1 in which the process speed is from 20 mm/sec. or more to less than 130 mm/sec. and, where the maximum value and minimum value of gloss value of the image having been fixed are represented by $G_{max1}$ and $G_{min1}$, respectively, the $G_{max1}$ and the $G_{min1}$ satisfy the following expressions:

$G_{max1} \leqq G_0+40$ and $G_0-25$; and (ii) when a recording medium having a low gloss ($0 \leqq G_0 \leqq 40$) is used, an image is formed at a high-speed mode PS2 in which the process speed is from 130 mm/sec. or more to 600 mm/sec. or less and, where the maximum value and minimum value of gloss value of the image having been fixed are represented by $G_{max2}$ and $G_{min2}$, respectively, the $G_{max2}$ and the $G_{min2}$ satisfy the following expressions:

$G_{max2} \leqq G_0+20$ and $G_{min2} \geqq G_0-15$.

2. The image-forming method according to claim 1, wherein, in said fixing step, the toner images are heated and fixed by means of a heating member comprising a substrate and provided thereon an elastic layer having at least an Asker-C hardness of from 50 to 90 and a thickness of from 0.5 mm to 5 mm.

3. The image-forming method according to claim 2, wherein said heating member has on said elastic layer a surface layer formed of a fluorine resin, having a layer thickness of from 10 $\mu$m to 100 $\mu$m and having an average surface roughness Ra of Ra$\leqq$2.

4. The image-forming method according to claim 1, wherein said toner contains at least a binder resin, a release agent and a colorant, and has, in the endothermic curve in the range of temperature of from 30° C. to 200° C. in the measurement by differential thermal analysis DSC, a peak temperature of a maximum endothermic peak within the range of temperature of from 50° C. to 110°C.

5. The image-forming method according to claim 4, wherein said binder resin is a resin selected from any of (a) a polyester resin, (b) a hybrid resin having a polyester unit and a vinyl polymer unit, (c) a mixture of the hybrid resin and a vinyl polymer, (d) a mixture of the polyester resin and a vinyl polymer and (e) a mixture of the hybrid resin and the polyester resin.

6. The image-forming method according to claim 1, wherein said toner has, in its viscoelasticity characteristics, a storage elastic modulus at a temperature of 80° C., $G'_{80}$, within the range of from $1\times10^6$ to $1\times10^8$ dN/m$^2$, and a storage elastic modulus at a temperature of from 120° C. to 180° C. having a minimum value $G'_{min}$ and a maximum value $G'_{max}$, each being within the range of from $5\times10^3$ to $1\times10^6$ dN/m$^2$, the ratio $G'_{max}/G'_{min}$ being 20 or less.

7. The image-forming method according to claim 1, wherein said toner contains a metallic compound of an aromatic carboxylic acid derivative.

8. The image-forming method according to claim 7, wherein said metallic compound of an aromatic carboxylic acid derivative is an aluminum compound of the aromatic carboxylic acid derivative.

9. The image-forming method according to claim 1, wherein said toner has a weight-average particle diameter of from 4 $\mu$m to 10 $\mu$m.

10. The image-forming method according to claim 1, wherein said toner has a coloring power that the image density $D_{0.5}$ after fixing at the time the toner laid-on quantity on the recording medium is 0.5 mg/cm$^2$ is:

(i) 1.2 or more when the image is formed in the low-speed mode; and (ii) 1.0 or more when the image is formed in the high-speed mode.

11. An image-forming method comprising:

(i) a developing step of developing an electrostatic latent image held on an image-bearing member, by means of a toner to obtain a toner image;

(ii) a transfer step of transferring the toner image to a recording medium; and (iii) a fixing step of heating the toner image having been transferred onto the recording medium, to fix the former to the latter, wherein said fixing step is carried out only once; and having at least:

a low-speed mode (PS1) in which images are formed at a low speed, wherein a process speed in said low-speed mode is from 20 mm/sec or more to less than 130 mm/sec; and a high-speed mode (PS2) in which images are formed at a high speed, wherein a process speed in said high-speed mode is from 130 mm/sec. or more to 600 mm/sec;

so as to be able to form images at different speeds; and in said fixing step, the relationship between fixing temperature T1 (° C.) in the low-speed mode and fixing temperature T2 (° C.) in the high-speed mode being:

$T2 \leqq T1-5$.

12. An image-forming method comprising:

a developing step of developing an electrostatic latent image held on an image-bearing member, by means of a toner to obtain a toner image;

a transfer step of transferring the toner image to a recording medium; and a fixing step of heating the toner image having been transferred onto the recording medium, to fix the former to the latter; and having at least:

a low-speed mode (PS1) in which images are formed at a low speed; and a high-speed mode (PS2) in which images are formed at a high speed;

so as to be able to form images at different speeds;

said toner being laid on said recording medium in a quantity ranging from 0.05 mg/cm$^2$ or more to 1.3 mg/cm$^2$ or less, where;

(i) when a recording medium having $G_0$ of 50 (basis weight: 148 g/m$^2$) is used and an image is formed under conditions of a process speed of 60 mm/sec. and a fixing temperature of 170° C. and, where the maximum value and minimum value of gloss value of the fixed image obtained are represented by $G_{max1}$ and $G_{min1}$, respectively, the $G_{max1}$ and the $G_{min1}$ satisfy the following expressions:

$G_{max1} \leqq 90$ and $G_{min1} \geqq 25$; and (ii) when a recording medium having $G_0$ of 2 (basis weight: 81.4 g/m$^2$) is used and an image is formed by fixing performed under conditions of a process speed of 250 mm/sec. and a fixing temperature of 160° C. and, where the maximum value and minimum value of gloss value of the fixed image obtained are represented by $G_{max2}$ and $G_{min2}$, respectively, the $G_{max2}$ and the $G_{min2}$ satisfy the following expressions:

$G_{max2} \leqq 22$ and $G_{min2} \geqq 0$.

* * * * *

UNITED STATES PATENT AND TRADEMARK OFFICE

CERTIFICATE OF CORRECTION

PATENT NO. : 6,751,424 B2
DATED : June 15, 2004
INVENTOR(S) : Nozomu Komatsu et al.

It is certified that error appears in the above-identified patent and that said Letters Patent is hereby corrected as shown below:

Column 2,
Line 27, “disclosed-in” should read -- disclosed in --.

Column 5,
Line 8, “detail;” should read -- detail, --.

Column 10,
Line 42, “be” should read -- been --.

Column 12,
Line 32, “such as” (first occurrence) should be deleted.

Column 14,
Line 35, “a” should be deleted.

Column 17,
Line 49, “form” should read -- from --.

Column 18,
Line 45 , “example’ should read -- example, --.

Column 19,
Line 31, “after” should read -- after being --.

Column 20,
Line 66, “more be” should read -- be more --.

Column 22,
Line 17, “form” should read -- from --.

Column 26,
Line 5, “60% RH)” should read -- 60% RH). --.

Column 27,
Line 46, “had” should read -- had, --.

Column 28,
Line 10, “parts-by” should read -- parts by --.

UNITED STATES PATENT AND TRADEMARK OFFICE

CERTIFICATE OF CORRECTION

PATENT NO. : 6,751,424 B2 
DATED : June 15, 2004
INVENTOR(S) : Nozomu Komatsu et al.

It is certified that error appears in the above-identified patent and that said Letters Patent is hereby corrected as shown below:

Column 32,
Line 33, "$6.5 \times 10^5$ should read -- $6.5 \times 10^3$
$4.5 \times 10^5$" $4.5 \times 10^4$ --.

Column 35,
Line 44, "which;" should read -- which: --; and
Line 54, "$G_0$ - 25; and" should read -- $G_{min1} \geq G_0 - 25$; and --.

Column 37,
Line 15, "20 mm/sec" should read -- 20 mm/sec. --.

Column 38,
Line 12, "where;" should read -- where: --.

Signed and Sealed this

Twenty-eighth Day of September, 2004

JON W. DUDAS
*Director of the United States Patent and Trademark Office*